US010619921B2

(12) United States Patent
Brodie et al.

(10) Patent No.: US 10,619,921 B2
(45) Date of Patent: Apr. 14, 2020

(54) DUAL PATH KILN AND METHOD OF OPERATING A DUAL PATH KILN TO CONTINUOUSLY DRY LUMBER

(71) Applicant: NOREV DPK, LLC, Effingham, SC (US)

(72) Inventors: T. Furman Brodie, Florence, SC (US); James L. Anderson, Florence, SC (US); Christopher E. Stewart, Effingham, SC (US); William Shayne Smoke, Homer, LA (US); Levi Anderson Pollard, V, Appling, GA (US); Douglas Monroe Tinsley, Hot Springs, AR (US)

(73) Assignee: NOREV DPK, LLC, Effingham, SC (US)

( * ) Notice: Subject to any disclaimer, the term of this patent is extended or adjusted under 35 U.S.C. 154(b) by 0 days.

(21) Appl. No.: 16/246,576

(22) Filed: Jan. 14, 2019

(65) Prior Publication Data

US 2019/0234686 A1 Aug. 1, 2019

Related U.S. Application Data

(60) Provisional application No. 62/623,080, filed on Jan. 29, 2018.

(51) Int. Cl.
*F26B 25/06* (2006.01)
*F26B 15/12* (2006.01)
(Continued)

(52) U.S. Cl.
CPC ..... *F26B 15/12* (2013.01); *F26B 3/04* (2013.01); *F26B 21/004* (2013.01); *F26B 21/04* (2013.01);
(Continued)

(58) Field of Classification Search
CPC ..... F26B 15/12; F26B 15/14; F26B 15/18; F26B 15/22; F26B 3/02; F26B 3/04;
(Continued)

(56) References Cited

U.S. PATENT DOCUMENTS 997,092 A 7/1911 Reyscher
1,328,661 A 1/1920 Fish
(Continued)

FOREIGN PATENT DOCUMENTS

CH 677527 A 5/1991
CH 677527 A5 5/1991
(Continued)

OTHER PUBLICATIONS https://www.systemsensor.com/en-us/_layouts/ss/search.aspx?k=Aspiration-Conventional-Detectors, downloaded Jan. 14, 2019, pp. 1-2.
(Continued)

*Primary Examiner* — John P McCormack
(74) *Attorney, Agent, or Firm* — Jeffrey S. Melcher; Melcher Patent Law PLLC

(57) ABSTRACT

A dual path kiln is provided that includes a kiln having at least three chambers including first and second end chambers separated by a central heating chamber. At least two lumber conveyors convey lumber through the kiln in opposite directions. External unidirectional fans are utilized to provide circular directional flows through the lumber. Also provided is a method utilizing the kiln to continuously dry green lumber.

24 Claims, 9 Drawing Sheets

(51) Int. Cl.

| | |
|---|---|
| ***F26B 3/04*** | (2006.01) |
| ***F26B 21/04*** | (2006.01) |
| ***F26B 25/12*** | (2006.01) |
| ***F26B 21/00*** | (2006.01) |
| ***F26B 25/00*** | (2006.01) |
| ***F26B 23/00*** | (2006.01) |

(52) U.S. Cl.
CPC ..... *F26B 23/00* (2013.01); *F26B 25/008* (2013.01); *F26B 25/12* (2013.01); *F26B 2210/16* (2013.01)

(58) Field of Classification Search
CPC ..... F26B 3/06; F26B 23/001; F26B 25/008; F26B 25/12; F26B 21/004; F26B 21/04; F26B 2210/16
USPC ..... 34/201, 203–207, 209, 210, 216–218, 34/230–233
See application file for complete search history.

(56) References Cited

U.S. PATENT DOCUMENTS 1,366,225 A 1/1921 Weiss
1,413,018 A 4/1922 Kakuji
1,593,598 A 7/1926 Redman
1,885,418 A 11/1932 Darrah
1,953,193 A 4/1934 Sampson
2,001,001 A * 5/1935 Thelen ..... F26B 9/06 34/191
2,060,111 A 11/1936 Phillips
2,185,760 A 1/1940 Altenkirch
2,202,143 A 5/1940 Cobb
2,237,255 A 4/1941 Finnegan
2,288,154 A 6/1942 Cobb
2,363,294 A 11/1944 Carrier
2,363,945 A 11/1944 Carrier
2,383,504 A 8/1945 Luckhaupt
2,397,993 A 4/1946 Urquhart
2,408,434 A 10/1946 Mann
2,425,660 A 8/1947 Ware
2,463,782 A 3/1949 Leischner
2,519,340 A 8/1950 Bailey
2,521,554 A 9/1950 Ware
2,527,782 A 10/1950 Williams
2,529,366 A 11/1950 Bauer
2,575,426 A 11/1951 Parnell
2,593,709 A 4/1952 Ware
2,603,004 A 7/1952 Quimby
2,687,192 A 8/1954 Butterfield
2,706,344 A 4/1955 Vaughan
2,717,825 A 9/1955 Greenawalt
2,834,120 A 5/1958 Greenhood
2,860,070 A 11/1958 McDonald
2,892,261 A 6/1959 Hutchinson
2,956,933 A 10/1960 Jolin
2,992,152 A 7/1961 Chapman
3,002,877 A 10/1961 McDonald
3,061,878 A 11/1962 Chapman
3,090,130 A 5/1963 Smith
3,196,554 A 7/1965 Smith
3,199,213 A 8/1965 Milligan
3,233,097 A 2/1966 Watkins
3,234,659 A 2/1966 Smith
3,262,216 A 7/1966 Dugger
3,269,136 A 8/1966 Umano
3,307,529 A 3/1967 Fannon
3,324,939 A 6/1967 Laing
3,334,595 A 8/1967 Natof
3,337,967 A 8/1967 Smith
3,449,116 A 6/1969 Derham
3,470,623 A 10/1969 Hildebrand
3,529,358 A 9/1970 Robinson
3,545,094 A 12/1970 Barnes
3,571,943 A 3/1971 Sipple
3,574,949 A 4/1971 Farnsworth
3,589,313 A 6/1971 Smith
3,680,219 A 8/1972 Koch
3,714,716 A 2/1973 Dedrick
3,721,013 A 3/1973 Miller
3,741,890 A 6/1973 Smith
3,744,147 A 7/1973 Pless
3,757,428 A 9/1973 Runciman
3,782,000 A 1/1974 Pless
3,818,601 A 6/1974 Cooper
3,861,150 A 1/1975 Lear
3,902,253 A 9/1975 Sabuzawa
3,913,351 A 10/1975 Edwards
3,933,128 A 1/1976 Cramer
3,939,573 A 2/1976 Berti
3,945,331 A 3/1976 Drake
3,967,466 A 7/1976 Edwards
3,986,268 A 10/1976 Koppelman
4,014,107 A 3/1977 Bachrich
4,017,980 A 4/1977 Kleinguenther
4,031,631 A 6/1977 Robinson
4,033,113 A 7/1977 Cramer
4,071,637 A 1/1978 Dittrich
4,106,215 A 8/1978 Rosen
4,111,744 A 9/1978 Reiniger
4,121,350 A 10/1978 Buchholtz
4,122,356 A 10/1978 Decker
4,148,356 A 4/1979 Cramer
4,169,583 A 10/1979 Cramer
4,176,466 A 12/1979 Pagnozzi
4,182,048 A 1/1980 Wolfe
4,194,296 A 3/1980 Pagnozzi
4,196,526 A 4/1980 Berti
4,212,635 A 7/1980 North
4,213,947 A 7/1980 Fremont
4,228,783 A 10/1980 Kalenian
4,233,024 A 11/1980 Plass
4,261,110 A 4/1981 Northway
4,280,878 A 7/1981 Sprenger
4,298,560 A 11/1981 Plass
4,343,607 A 8/1982 Coleman
4,348,211 A 9/1982 Zimmerman
4,357,758 A 11/1982 Lampinen
4,378,640 A 4/1983 Buchholtz
4,399,619 A 8/1983 Martin
4,403,948 A 9/1983 Waldmann
4,416,069 A 11/1983 Rosen
4,420,299 A 12/1983 De Mets
4,432,147 A 2/1984 Chen
4,445,559 A 5/1984 Coleman
4,445,910 A 5/1984 Zimmerman
4,455,837 A 6/1984 Firey
4,466,198 A 8/1984 Doll
4,467,532 A 8/1984 Drake
4,468,256 A 8/1984 Hinger
4,484,531 A 11/1984 Firey
4,490,926 A 1/1985 Stokes
4,495,165 A 1/1985 Gurza
4,497,637 A 2/1985 Purdy
4,501,205 A 2/1985 Funk
4,530,700 A 7/1985 Sawyer
4,545,360 A 10/1985 Smith
4,554,076 A 11/1985 Speaker
4,559,882 A 12/1985 Dobson
4,561,261 A 12/1985 Kornrumpf
4,564,368 A 1/1986 Sawyer
4,580,354 A 4/1986 Lindberg
4,620,373 A 11/1986 Laskowski
4,621,503 A 11/1986 Woods
4,663,860 A 5/1987 Beall
4,675,029 A 6/1987 Norman
4,690,611 A 9/1987 Nobuhara
4,722,322 A 2/1988 Vamey
4,771,708 A 9/1988 Douglass
4,781,778 A 11/1988 Olofsson
4,862,599 A 9/1989 Brunner
4,908,104 A 3/1990 Loomans
4,922,624 A 5/1990 Tharpe
RE33,273 E 7/1990 Speaker

(56) References Cited

U.S. PATENT DOCUMENTS 4,941,521 A 7/1990 Redekop
5,017,269 A 5/1991 Loomans
5,059,404 A 10/1991 Mansour
5,062,372 A 11/1991 Ritter
5,171,613 A 12/1992 Bok
5,188,740 A 2/1993 Khan
5,240,656 A 8/1993 Scheeres
5,243,963 A 9/1993 Riener
5,256,255 A 10/1993 Fagerlund
5,263,266 A 11/1993 Schmidt
5,269,076 A 12/1993 Breckenridge
5,271,340 A 12/1993 Whitney
5,279,712 A 1/1994 Constantine
5,293,700 A 3/1994 Ishii
5,297,957 A 3/1994 Brashears
5,306,481 A 4/1994 Mansour
5,325,604 A 7/1994 Little
5,345,695 A 9/1994 Graham
5,363,780 A 11/1994 Whitney
5,399,039 A 3/1995 Giles
5,406,316 A 4/1995 Schwiebert
5,406,321 A 4/1995 Schwiebert
5,413,746 A 5/1995 Birjukov
5,416,985 A 5/1995 Culp
5,425,182 A 6/1995 Brunner
5,447,003 A * 9/1995 Warren ..... F26B 25/12 34/201
5,454,426 A 10/1995 Moseley
5,461,408 A 10/1995 Giles
5,479,199 A 12/1995 Moore
5,500,667 A 3/1996 Schwiebert
5,534,437 A 7/1996 Arrau
5,536,488 A 7/1996 Mansour
5,557,858 A 9/1996 Macaluso
5,581,289 A 12/1996 Firl
5,595,000 A 1/1997 Goodwin
5,606,859 A 3/1997 Ploshkin
5,633,668 A 5/1997 Schwiebert
5,637,192 A 6/1997 Mansour
5,641,273 A 6/1997 Moseley
5,678,324 A 10/1997 Viitaniemi
5,685,153 A 11/1997 Dickinson
5,687,490 A 11/1997 Harrison
5,704,134 A 1/1998 Carter
5,758,434 A 6/1998 Gipson
5,770,267 A 6/1998 Bullock
5,784,805 A 7/1998 Hashimoto
5,788,865 A 8/1998 Smirnov
5,797,332 A 8/1998 Keller
5,815,945 A 10/1998 Ando
5,836,086 A 11/1998 Elder
5,851,246 A 12/1998 Bishop
5,851,309 A 12/1998 Kousa
5,852,880 A 12/1998 Harrison
5,873,182 A 2/1999 Fuller
5,878,509 A 3/1999 Burnett
5,899,004 A 5/1999 Sugaoka
5,901,463 A 5/1999 Guyonnet
5,915,811 A 6/1999 DeVore
5,926,968 A 7/1999 Gipson
5,940,984 A 8/1999 Moren
5,964,985 A 10/1999 Wootten
5,966,837 A 10/1999 Backa
5,970,624 A 10/1999 Moriya
5,979,074 A 11/1999 Brunner
5,992,047 A 11/1999 Fuller
5,992,048 A 11/1999 DeVore
6,013,158 A 1/2000 Wootten
6,014,819 A 1/2000 Elder
6,024,226 A 2/2000 Olivier
RE36,728 E 6/2000 Ishii
6,105,278 A 8/2000 Gerrish
6,108,941 A 8/2000 Gillespy
6,110,316 A 8/2000 Kobayashi
6,112,677 A 9/2000 Kuntschar
6,119,364 A 9/2000 Elder
6,138,379 A 10/2000 DeVore
6,141,888 A 11/2000 Cammarata
6,149,765 A 11/2000 Mansour
6,219,937 B1 4/2001 Culp
6,233,545 B1 5/2001 Datig
6,243,970 B1 6/2001 Culp
6,248,985 B1 6/2001 Tomasello
6,293,121 B1 9/2001 Labrador
6,327,994 B1 12/2001 Labrador
6,341,372 B1 1/2002 Datig
6,344,638 B1 2/2002 Tomasello
6,345,450 B1 2/2002 Elder
6,348,679 B1 2/2002 Ryan
6,355,904 B1 3/2002 Batdorf
6,370,792 B1 4/2002 Culp
6,379,929 B1 4/2002 Burns
6,381,871 B2 5/2002 Uehara
6,393,723 B1 5/2002 Nagel
6,393,727 B1 5/2002 Seelig
6,467,190 B2 10/2002 Nagel
6,467,300 B1 10/2002 Noble, III
6,473,994 B1 11/2002 Dedieu
6,551,457 B2 4/2003 Westman
6,553,688 B1 4/2003 Lee
6,574,979 B2 6/2003 Faqih
6,600,142 B2 7/2003 Ryan
6,617,557 B1 9/2003 Ryan
6,640,462 B1 11/2003 Choi
6,649,888 B2 11/2003 Ryan
6,652,274 B2 11/2003 Nagel
6,667,429 B2 12/2003 Abe
6,675,495 B2 1/2004 Dedieu
6,680,456 B2 1/2004 Adams
6,684,648 B2 2/2004 Faqih
6,725,566 B1 4/2004 Skrotsky
6,729,043 B2 5/2004 Muhlbock
6,742,278 B2 6/2004 Vinden
6,742,283 B2 6/2004 Ishii
6,772,535 B2 8/2004 Koslow
6,796,476 B2 9/2004 Birk
6,817,556 B2 11/2004 Hesch
6,865,821 B2 3/2005 Merschat
6,868,690 B2 3/2005 Faqih
6,969,409 B2 11/2005 Ichimura
7,028,478 B2 4/2006 Prentice, III
7,043,853 B2 5/2006 Roberts
7,044,429 B1 5/2006 Foreman
7,089,685 B2 8/2006 Torgovnikov
7,135,332 B2 11/2006 Ouellette
7,146,747 B2 12/2006 Studd
7,169,489 B2 1/2007 Redmond
7,178,263 B2 2/2007 Asano
7,178,941 B2 2/2007 Roberge
7,220,365 B2 5/2007 Qu
7,226,675 B2 6/2007 Ovshinsky
7,241,322 B2 7/2007 Graham
7,246,452 B1 7/2007 Roy
7,248,942 B2 7/2007 Bash
7,281,561 B2 10/2007 Anderson
7,337,554 B2 3/2008 Erickson
7,370,434 B2 5/2008 Duncan
7,473,551 B2 1/2009 Warthoe
7,498,009 B2 3/2009 Leach
7,511,443 B2 3/2009 Townsend
7,523,603 B2 4/2009 Hagen
7,589,883 B2 9/2009 Varaprasad
7,612,735 B2 11/2009 Essig
7,624,801 B2 12/2009 Zubrin
7,637,030 B2 12/2009 Sugawara
7,638,070 B2 12/2009 Johnson
7,643,200 B2 1/2010 Varaprasad
7,650,939 B2 1/2010 Zubrin
7,676,953 B2 3/2010 Magill
7,683,126 B2 3/2010 Neal
7,685,819 B2 3/2010 Vetrovec
7,690,148 B2 4/2010 Hedman
7,694,688 B2 4/2010 Lester
7,700,027 B2 4/2010 Neal

(56) References Cited

U.S. PATENT DOCUMENTS

| | | | | |
|---|---|---|---|---|
| 7,703,301 | B2 | 4/2010 | Loibl | |
| 7,707,848 | B2 | 5/2010 | Loibl | |
| 7,732,039 | B2 | 6/2010 | Chakravarty | |
| 7,744,671 | B1 | 6/2010 | Ouellette | |
| 7,752,845 | B2 | 7/2010 | Johnson | |
| 7,761,954 | B2 | 7/2010 | Ziegler | |
| 7,792,711 | B2 | 9/2010 | Swofford | |
| 7,810,565 | B2 | 10/2010 | Zubrin | |
| 7,821,697 | B2 | 10/2010 | Varaprasad | |
| 7,841,282 | B2 | 11/2010 | Kimberlin | |
| 7,854,631 | B2 | 12/2010 | Townsendl | |
| 7,855,755 | B2 | 12/2010 | Weller | |
| 7,857,995 | B2 | 12/2010 | Johnson | |
| 7,893,644 | B2 | 2/2011 | Townsend | |
| 7,906,695 | B2 | 3/2011 | Giercke | |
| 7,963,048 | B2 | 6/2011 | Pollard | |
| 8,201,501 | B2 | 6/2012 | Tinsley | |
| 8,342,102 | B2 | 1/2013 | Tinsley | |
| 9,200,834 | B1 * | 12/2015 | Ball, Jr. | F26B 25/063 |
| 9,299,834 | B2 | 3/2016 | Zundel et al. | |
| 9,423,176 | B1 * | 8/2016 | Girardi | F26B 3/02 |
| 2001/0001218 | A1 | 5/2001 | Luongo | |
| 2002/0002208 | A1 | 1/2002 | Martel | |
| 2002/0030721 | A1 | 3/2002 | Asakawa | |
| 2002/0108266 | A1 | 8/2002 | Nagel | |
| 2003/0029052 | A1 | 2/2003 | Nagel | |
| 2003/0066638 | A1 | 4/2003 | Qu | |
| 2003/0115771 | A1 | 6/2003 | Ishii | |
| 2003/0140751 | A1 | 7/2003 | McGehee | |
| 2003/0154622 | A1 | 8/2003 | Aaron | |
| 2003/0182819 | A1 | 10/2003 | Michon | |
| 2004/0168339 | A1 | 9/2004 | Roberts | |
| 2004/0171707 | A1 | 9/2004 | Martel | |
| 2005/0109603 | A1 | 5/2005 | Graham | |
| 2005/0120715 | A1 | 6/2005 | Labrador | |
| 2005/0220662 | A1 | 10/2005 | Hedman | |
| 2005/0223591 | A1 | 10/2005 | Huard | |
| 2005/0266200 | A1 | 12/2005 | Padmanabhan | |
| 2005/0283992 | A1 | 12/2005 | Kettler | |
| 2006/0080856 | A1 | 4/2006 | Erickson | |
| 2006/0101663 | A1 | 5/2006 | Perin | |
| 2006/0110499 | A1 | 5/2006 | Neto | |
| 2006/0112639 | A1 | 6/2006 | Nick | |
| 2006/0163272 | A1 | 7/2006 | Gamble | |
| 2006/0168842 | A1 * | 8/2006 | Sprague | F26B 23/002 34/396 |
| 2006/0191158 | A1 | 8/2006 | Duncan | |
| 2006/0196398 | A1 | 9/2006 | Graham | |
| 2006/0237381 | A1 | 10/2006 | Lockwood | |
| 2006/0272172 | A1 | 12/2006 | Pollard | |
| 2006/0277784 | A1 | 12/2006 | Cheng | |
| 2006/0278336 | A1 | 12/2006 | Sundholm | |
| 2006/0280670 | A1 | 12/2006 | Teeter | |
| 2007/0000146 | A1 | 1/2007 | Boonstra | |
| 2007/0017113 | A1 | 1/2007 | Scharpf | |
| 2007/0033826 | A1 | 2/2007 | Seeger | |
| 2007/0044341 | A1 * | 3/2007 | Pollard | F26B 15/12 34/201 |
| 2007/0089805 | A1 | 4/2007 | Swaan | |
| 2007/0130788 | A1 | 6/2007 | Kunugi | |
| 2007/0173679 | A1 | 7/2007 | Guyomareh | |
| 2007/0187223 | A1 | 8/2007 | Graham | |
| 2008/0014111 | A1 | 1/2008 | Hedman | |
| 2008/0022548 | A1 | 1/2008 | Maynard | |
| 2008/0034681 | A1 | 2/2008 | McDonald | |
| 2008/0104859 | A1 * | 5/2008 | Wolowiecki | F26B 13/10 34/417 |
| 2008/0155985 | A1 | 7/2008 | Labrador | |
| 2009/0013596 | A1 | 1/2009 | Wang | |
| 2009/0071062 | A1 | 3/2009 | Hedman | |
| 2009/0113752 | A1 | 5/2009 | Weir | |
| 2009/0266081 | A1 | 10/2009 | Graham | |
| 2010/0058607 | A1 | 3/2010 | Franich | |
| 2011/0056087 | A1 * | 3/2011 | Tinsley | F26B 15/16 34/201 |
| 2014/0259733 | A1 | 9/2014 | Blomquist | |
| 2015/0253079 | A1 | 9/2015 | Blomquist | |

FOREIGN PATENT DOCUMENTS

| | | | |
|---|---|---|---|
| DE | 3120844 | A1 | 12/1982 |
| DE | 3715511 | A1 | 5/1986 |
| DE | 4209452 | A1 | 11/1991 |
| DE | 4202392 | A1 | 8/1993 |
| DE | 4312189 | A1 | 10/1994 |
| DE | 19951627 | A1 | 12/1998 |
| EP | 429947 | A1 | 11/1990 |
| EP | 430910 | A1 | 6/1991 |
| EP | 447376 | A1 | 9/1991 |
| EP | 634648 | A1 | 3/1994 |
| EP | 1132701 | A2 | 9/2001 |
| EP | 1439359 | A2 | 7/2004 |
| EP | 1975531 | A1 | 10/2008 |
| FR | 2564850 | A1 | 5/1984 |
| FR | 2572170 | A1 | 10/1985 |
| FR | 2581743 | A1 | 5/1986 |
| FR | 2631432 | A1 | 5/1988 |
| GB | 2147400 | A | 5/1985 |
| GB | 2183319 | A | 6/1987 |
| GB | 2183807 | A | 6/1987 |
| GB | 2190179 | A | 11/1987 |
| GB | 2273761 | A | 6/1994 |
| GB | 2455078 | A | 6/2009 |
| JP | 52028055 | A | 3/1977 |
| JP | 56027822 | A | 3/1981 |
| JP | 62130801 | A | 6/1987 |
| JP | 63039309 | A | 2/1988 |
| JP | 63070048 | A | 3/1988 |
| JP | 01139134 | A | 5/1989 |
| JP | 01310287 | A | 12/1989 |
| JP | 02098404 | A | 4/1990 |
| JP | 02140590 | A | 5/1990 |
| JP | 02192584 | A | 7/1990 |
| WO | 9006840 | A1 | 6/1990 |
| WO | 9217744 | A1 | 10/1992 |
| WO | 9415159 | A1 | 7/1994 |
| WO | 9601401 | A1 | 1/1996 |
| WO | 9601971 | A1 | 1/1996 |
| WO | 9611780 | A1 | 4/1996 |
| WO | 9700412 | A1 | 1/1997 |
| WO | 9729894 | A1 | 8/1997 |
| WO | 159378 | A2 | 8/2001 |
| WO | 178955 | A2 | 10/2001 |
| WO | 2065038 | A1 | 8/2002 |
| WO | 3106126 | A1 | 12/2003 |
| WO | 2004099692 | A1 | 11/2004 |
| WO | 2005052478 | A1 | 6/2005 |
| WO | 2007083863 | A1 | 7/2007 |
| WO | 2007083864 | A1 | 7/2007 |
| WO | 2007130058 | A1 | 11/2007 |

OTHER PUBLICATIONS

International Search Report dated Apr. 8, 2017 in parent PCT application No. PCT/US19/13913, pp. 1-10.
Written Opinion dated Apr. 8, 2017 in parent PCT application No. PCT/US19/13913, pp. 1-6.

* cited by examiner

DUAL PATH KILN AND METHOD OF OPERATING A DUAL PATH KILN TO CONTINUOUSLY DRY LUMBER

FIELD OF THE INVENTION

The present invention relates to the field of kilns used in the continuous drying of lumber, and more particularly pertains to an improved kiln having a continuous green lumber feed and dry lumber discharge stream.

BACKGROUND OF THE INVENTION

As is well known, fresh cut lumber includes a large quantity of moisture and it has been the practice to subject such lumber to heat treatment to drive off the moisture so that the lumber, as sold, will be less subject to warping or bending during storage or after installation in a structure.

Drying lumber is typically performed in a batch kiln process, where an insulated chamber is used that is adapted to control several drying process conditions, including, but not limited to air temperature in the kiln, air speed across the lumber, and the relative humidity in the chamber. As these kilns are a closed atmosphere, packages of sawn lumber, often referred to as green lumber, separated by stickers are placed in the kiln in batches. The packages are often loaded vertically, horizontally, and end to end.

Once the batch of packages are in place, the chamber is closed and a schedule or recipe of temperatures and relative humidity is initiated for a determined time interval or until a certain moisture content in the lumber is achieved. Generally, the schedule gradually increases the temperature in the chamber and lowers the relative humidity. This allows the lumber to give up its moisture to the surrounding air, which may then be vented to the outside atmosphere.

The particular schedule used and the drying time varies depending on a number of factors, including, but not limited to, lumber type/species, thickness, moisture content, end use of the lumber and the like. Once the schedule has run, the kiln doors are opened and the packages are removed from the kiln chamber and further prepared for shipping to a final destination. This opens the chamber to atmospheric conditions and can often require a significant amount of time and energy to bring the next charge of green lumber up to drying conditions.

While lumber is typically dried as fast as possible depending on the cell structure, drying too rapidly can have adverse effects on the lumber, such as checking, splitting, warping, cupping, and the like. Accordingly, the temperature and humidity in the kiln, as well as the drying time will vary depending on the above listed factors. For example, Red Oak may take up to 28 days dry from green to 7% moisture content, while Southern Yellow Pine can be dried in approximately 20-24 hours from green to 15% moisture content.

As described in U.S. Pat. No. 7,963,048 (Pollard), U.S. Pat. No. 8,201,501 (Tinsley), and U.S. Pat. No. 8,342,102 (Tinsley), the complete disclosures of which are incorporated by reference herein, disclose the use of two generally parallel paths for separate continuous drying lines which are moved in opposite directions through a plurality of chambers which are aligned along the separate paths and in communication with one another to increase the efficiency of the drying process. This is accomplished by continuously moving loads of lumber while conserving the heat that builds up in each load as it is continuously moved along one path in the kiln and transferring some of that heat from a load of dried lumber to an incoming load of green lumber moving from the opposite end of the kiln as they pass one another in the kiln.

Prior art dual path kilns utilize internal reversible propeller fans because the flow of air through the lumber in central heating chamber must be periodically reversed, typically every three hours. Many of the prior art kilns also reverse the flow of air through the lumber in each of the end chambers. While the air flow through the lumber is being reversed, the lumber is not being dried. Furthermore, reversible fans are mechanically inefficient compared unidirectional fans. Moreover, since the fans are inside the hot central chamber they are fully exposed to a harsh environment.

There is a need for a continuous kiln that does not have the losses in productivity associated with fan reversals and can be used continuously to dry the lumber. There is also a need for a continuous kiln that can use single direction fans.

SUMMARY OF THE INVENTION

An objective of the invention is to provide a kiln that does not have to reverse the air flow through the lumber and also can utilize more efficient single direction external fans that are not externally exposed to the harsh environment in the central heating chamber.

The above objectives and other objectives can be obtained by a continuous kiln comprising:

- a first end chamber having a first kiln opening;
- a second end chamber having a second kiln opening;
- a central heating chamber connecting the first end chamber to the second end chamber;
- a first lumber conveyor configured to continuously convey a first green lumber in a first lumber direction into the first kiln opening, the first end chamber, the central heating chamber, the second end chamber, and convey a first dried lumber out the second end chamber;
- a second lumber conveyor configured to continuously convey a second green lumber in a second lumber direction opposite the first lumber direction and into the second kiln opening, the second end chamber, the central heating chamber, the first end chamber and convey a second dried lumber out the first end chamber;
- a first at least one unidirectional fan configured to form a first air flow through lumber travelling on the first and second conveyors in the first end chamber during operation of the kiln, the first unidirectional fan is external to the kiln;
- a second at least one unidirectional fan configured to form a second air flow through lumber travelling on the first and second conveyors in the second end chamber during operation of the kiln, the second unidirectional fan is external to the kiln; and
- a third at least one unidirectional fan configured to form a first central air flow through lumber travelling on the first and second conveyors in the central heating chamber during operation of the kiln, wherein the third unidirectional fan is external to the kiln.

The above objectives and other objectives can also be obtained by a method of continuously drying lumber in a kiln comprising:

- conveying a first green lumber on a first conveyor in a first direction into a first end chamber, a central heating chamber and a second end chamber of a kiln to form a first dry lumber exiting the central heating chamber into the second end chamber;

conveying a second green lumber on a second conveyor in a direction opposite the first direction into the second end chamber, the central heating chamber, and the first end chamber to form a second dry lumber exiting the central heating chamber;

providing in the first end chamber a first circular air flow through the first green lumber and second dry lumber in a direction of the second dry lumber to the first green lumber by a first at least one unidirectional fan external from the kiln to transfer heat from the second dry lumber to the first green lumber;

providing in a second end chamber a second circular air flow through the second green lumber and first dry lumber in a direction of the first dry lumber to the second green lumber by a second at least one unidirectional fan external from the kiln to transfer heat from the first dry lumber to the second green lumber;

providing in a first portion of the central heating chamber a first center circular air flow through the first green lumber and the second green lumber in a direction of the first green lumber to the second green lumber by a third at least one unidirectional fan external from the kiln; and providing in a second portion of the central heating chamber a second center circular air flow through the first green lumber and the second green lumber in a direction of the second green lumber to the first green lumber by another third at least one unidirectional fan external from the kiln.

The objectives and other objectives can further be obtained by a continuous kiln comprising:

a first end chamber having a first kiln opening;

a second end chamber having a second kiln opening;

a central heating chamber connecting the first end chamber to the second end chamber, the central heating chamber having a divider dividing the central heating chamber into a first central chamber and a second central chamber;

at least one lumber conveyor configured to continuously convey a green lumber in a lumber direction into the first lumber opening, first end chamber, the first central chamber, the second central chamber to form a dry lumber, convey the dry lumber through the second end chamber, and convey the dried lumber out the second kiln opening during operation of the kiln;

a first at least one unidirectional fan configured to form a first air flow through the green lumber travelling on the at least one conveyor in the first end chamber during operation of the kiln, the first unidirectional fan is external to the kiln;

a second at least one unidirectional fan configured to form a second air flow through the dry lumber travelling on the at least one conveyor in the second end chamber during operation of the kiln, the second unidirectional fan is external to the kiln;

a third at least one unidirectional fan configured to form a first central air flow through the green lumber travelling on the at least one conveyor in the first central chamber during operation of the kiln; and a fourth at least one unidirectional fan configured to form a second central air flow through the green lumber travelling on the at least one conveyor in the second central chamber during operation of the kiln, wherein the first at least one unidirectional fan and the second at least one unidirectional fan are configured to provide a circular air flow between the green lumber in the first end chamber and the dry lumber in the second end chamber during operation of the kiln, and wherein the third at least one unidirectional fan and the fourth at least one unidirectional fan are configured to provide a circular air flow between the green lumber in the first central chamber and the second central chamber during operation of the kiln.

The above objectives and other objectives can be obtained by a method of continuously drying lumber in a kiln comprising:

conveying a green lumber on at least one conveyor into a first kiln opening, a first end chamber, a first central chamber, a second central chamber, a second end chamber, and out of a second kiln opening, to form a second dry lumber exiting the second central chamber and entering the second end chamber;

providing heat to the first central chamber and the second central chamber;

providing a first circular air flow through the green lumber in the first end chamber and dry lumber in the second end chamber using at least one unidirectional fan external to the kiln to transfer heat from the dry lumber to the green lumber; and providing a second circular air flow through the green lumber in the first central chamber and the green lumber in the second central chamber to dry the green lumber and form the dry lumber exiting the second central chamber.

BRIEF DESCRIPTION OF THE DRAWINGS

The operation and advantages of the present invention will become apparent as consideration is given to the following detailed description in conjunction with the accompanying drawings, in which.

DETAILED DESCRIPTION OF THE INVENTION

Figure 1:
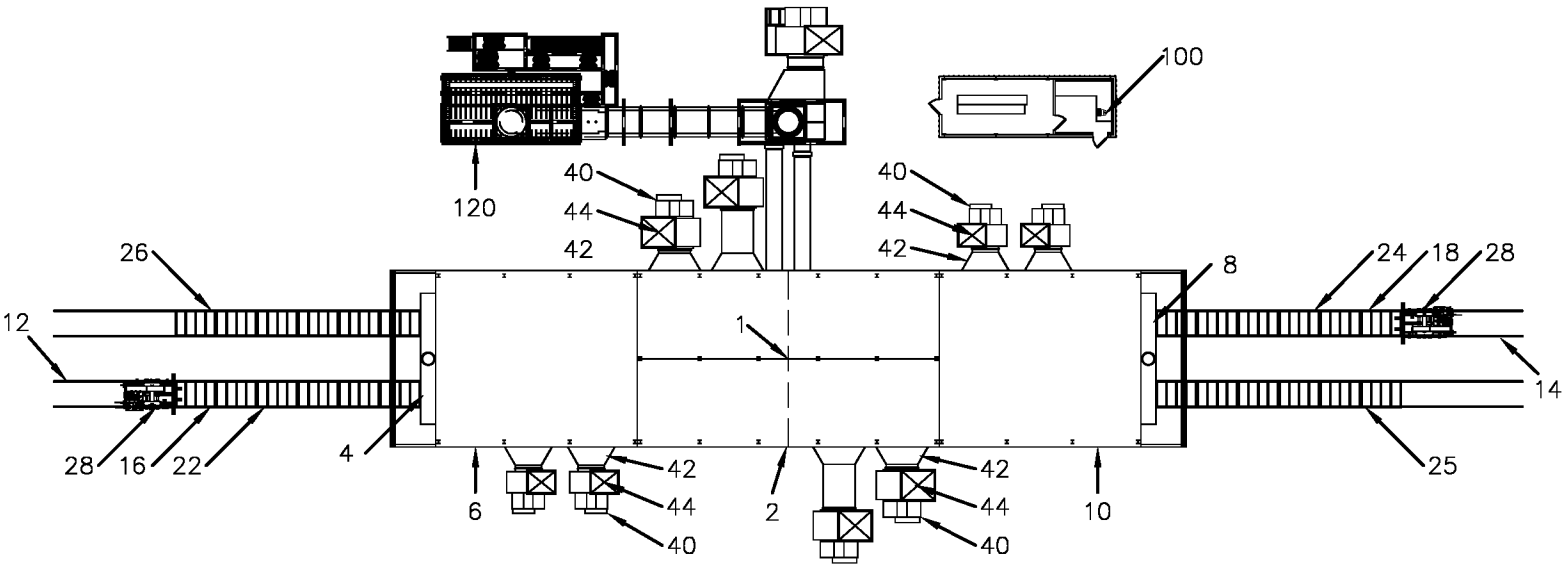
FIG. 1 is a top view of an improved continuous kiln arrangement.
Figure 2:
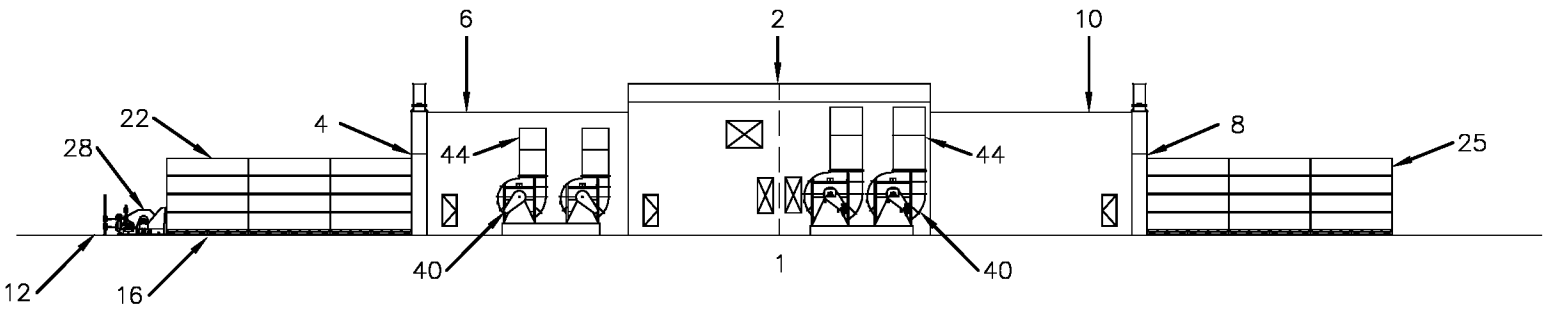
FIG. 2 is in side view of the continuous kiln arrangement of FIG. 1.
Figure 3:
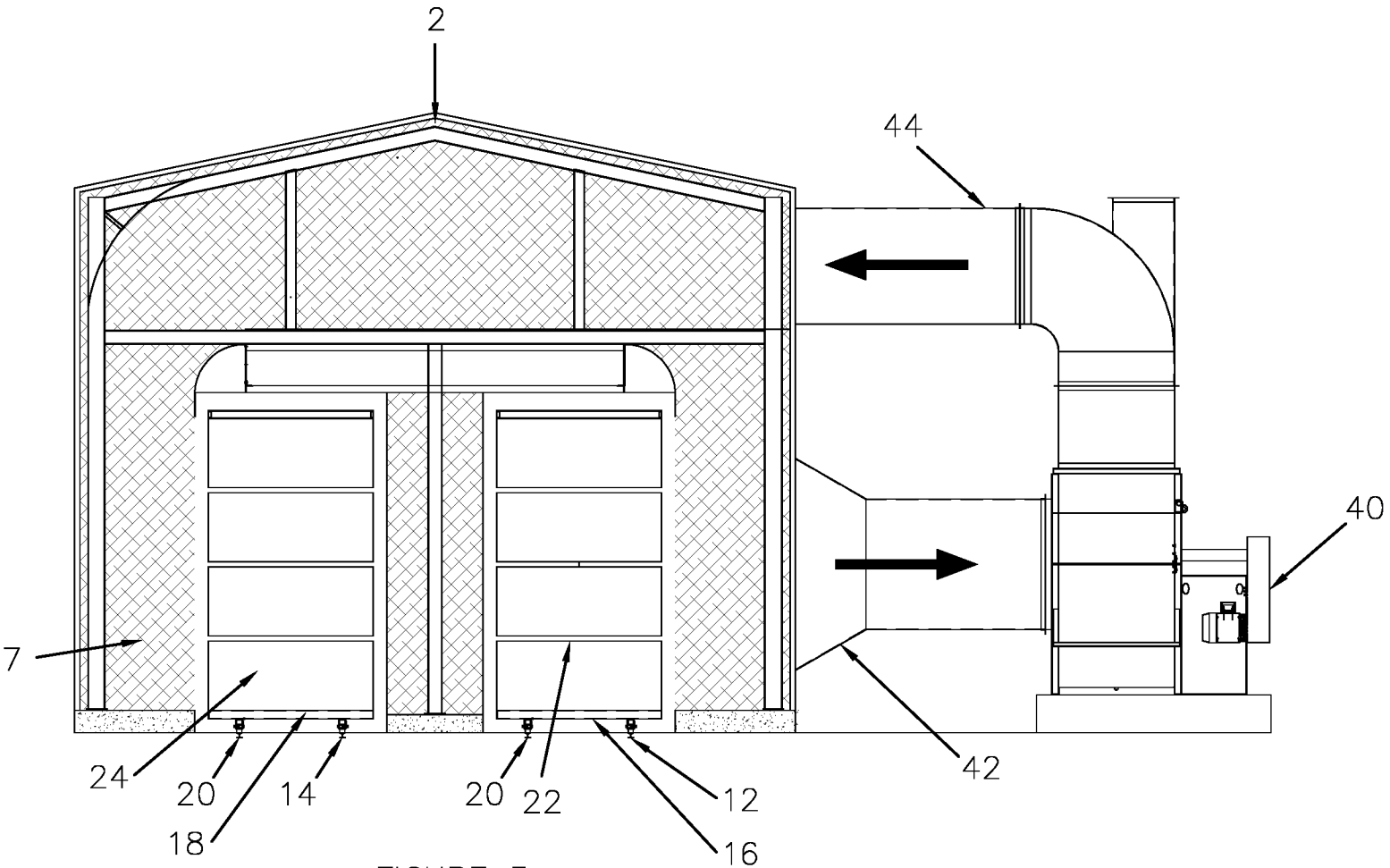
FIG. 3 is a side view of the continuous kiln arrangement of FIG. 1.
Figure 4:
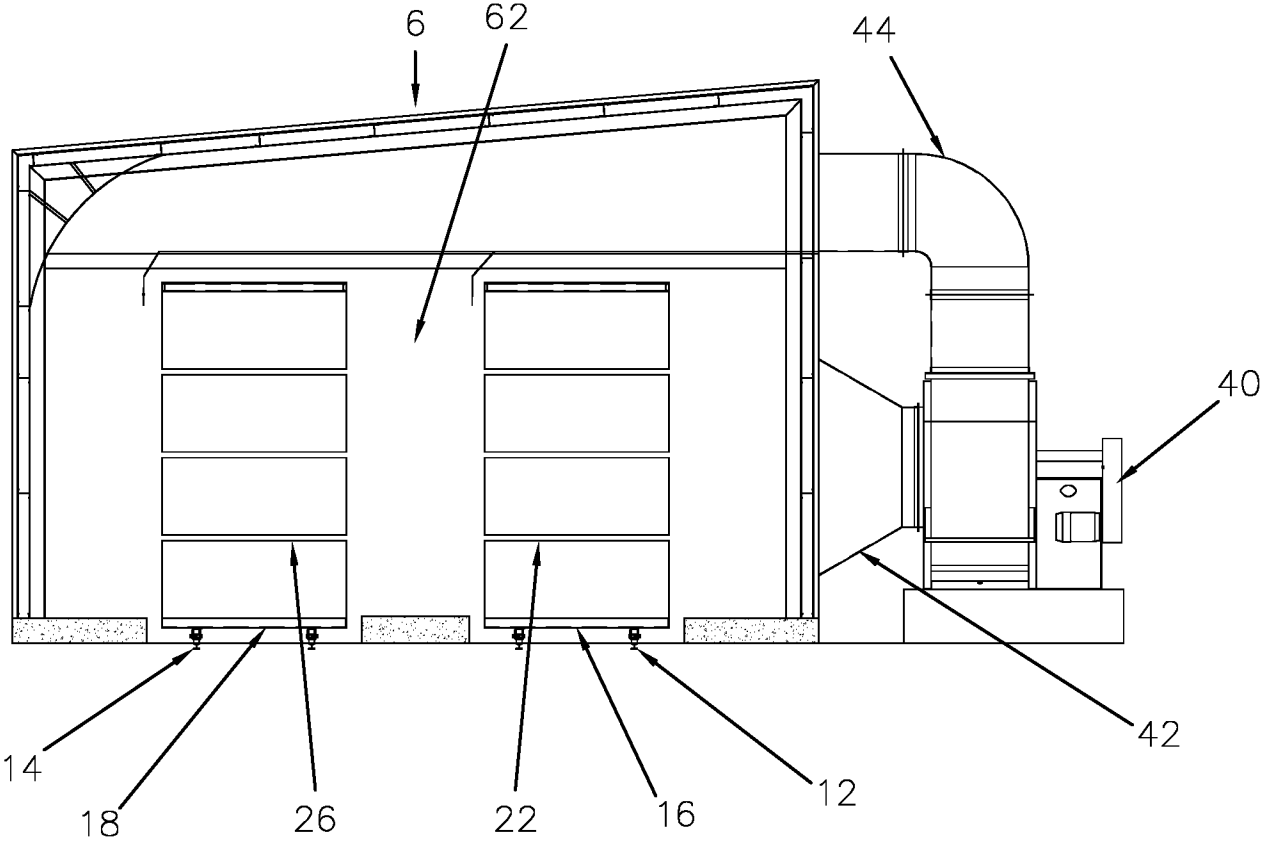
FIG. 4 is a side view of the continuous kiln arrangement of FIG. 1.

In the following detailed description, reference may be made to the accompanying drawings which form a part hereof, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Embodiments of the present invention are directed to a kiln 1 that can be used to perform a continuous type lumber drying process, where, in FIGS. 1-6, at least two different opposing lumber conveyors, first lumber conveyor 12 and second lumber conveyor 14, continuously move green lumber through a kiln 1 in opposing directions. Heat transfer between lumber carried on the first and second conveyors 12, 14 will take place aided by fans positioned to transfer heat between the passing loads of lumber as they are moved past one another.

The kiln 1 comprises three chambers, a first end chamber 6, a central heating chamber 2 and a second end chamber 10. Each of the chambers 2, 6 and 10 comprise walled structures defining an enclosure so that conditions within the chambers 2, 6, 10 can be controlled, such as air flow, temperature, and humidity. Each of the enclosures 2, 6 and 10 have openings for the conveyors 12, 14 to continuously convey lumber through the chambers 2, 6 and 10. Chambers 2, 6 and 10 are now well known and any suitable structures for the chambers 2, 6 and 10 can be utilized. The present invention is an improvement over conventional continuous dual path kilns 1 having chambers 2, 6 and 10. The kiln 1 can include any number additional chambers as desired. The chambers 2, 6 and 10 can be divided into sub chambers, for example as shown in the FIGS. 1-6 and described herein.

Figure 8:
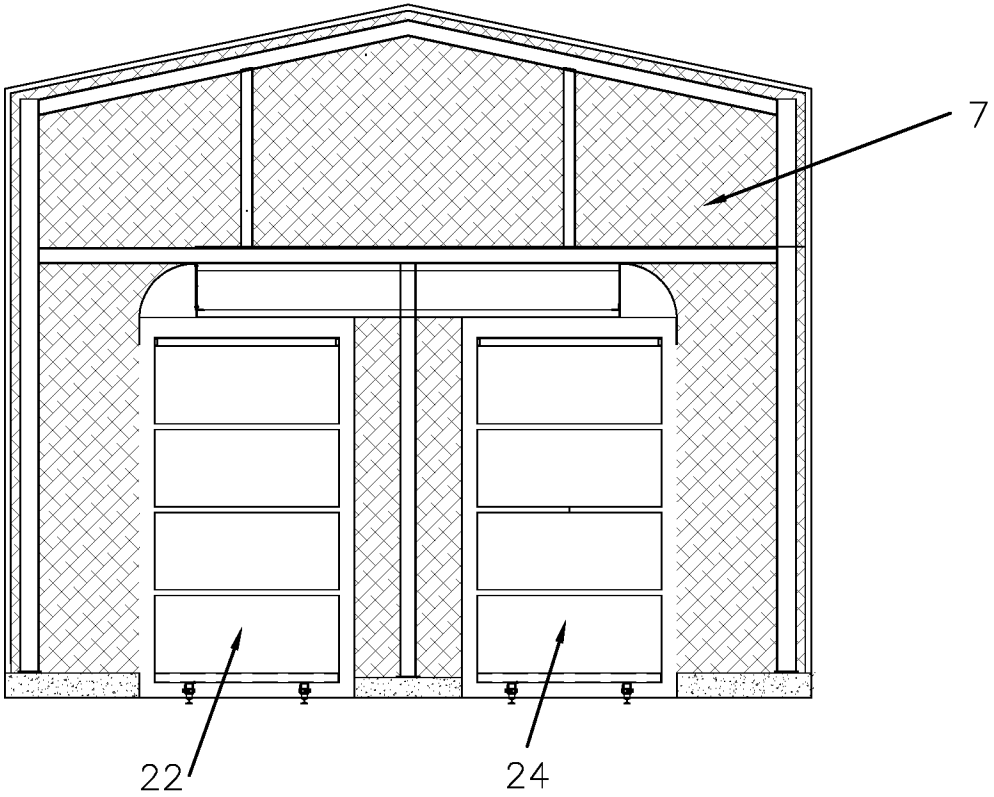
FIG. 8 illustrates an exemplary baffle.

The first end chamber 6 has a first kiln opening 4 and the first end chamber 6 is connected to the central heating chamber 2. The second end chamber 10 is has a second kiln opening 8 and the second end chamber 10 connected to the central heating chamber 2. A first baffle 7 separates the first end chamber 6 from the central heating chamber 2. A second baffle 9 separates the second end chamber 10 from the central heating chamber 2. The baffles 7 and 9 separate the heating air in the central heating chamber 2 from the air in each of the end chambers 6 and 10, and allow the lumber on the conveyors 12, 14 to travel through each of the chambers 2, 6 and 10. Preferably, the baffles 7 and 9 each comprise a wall from the ceiling to the floor in the chambers 2, 6 and 10, with openings for the conveyors 12, 14, an example of which is shown in FIG. 8.

Figure 9:
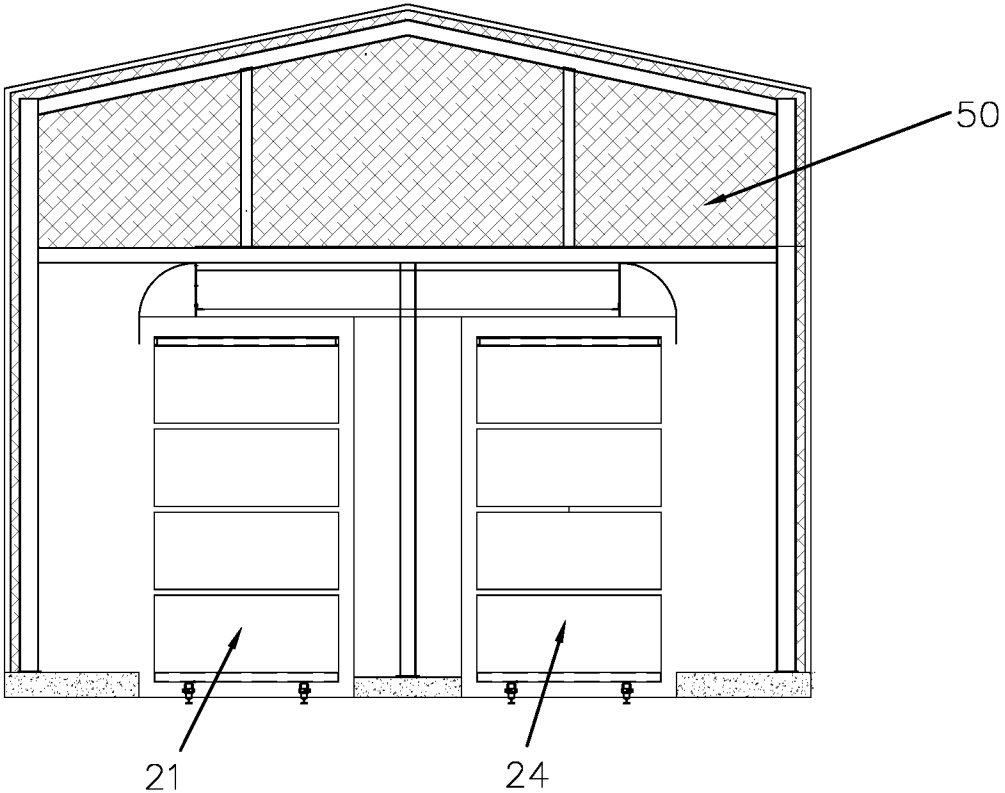
FIG. 9 illustrates an exemplary divider.

The central heating chamber 2 can be divided by a central heating divider 50 into to a first heating chamber 52 and a second heating chamber 54. The first end chamber 6 can be divided by a first end divider 60 into a first treatment chamber 62 and a first heat transfer chamber 64. The second end chamber 10 can be divided by a second end divider 66 into a second treatment chamber 70 and a second heat transfer chamber 68. The dividers 50, 60 and 66 preferably separate air flow in a upper portion of the chambers 2, 8 and 10. The dividers 50, 60, and 66 can comprise a wall from the ceiling to the floor in the chambers 2, 6 and 10, with openings for the conveyors 12, 14. However, preferably the dividers 50, 60 and 66 comprise a wall from the ceiling to a height above the floor, as shown in FIG. 9.

Any suitable conveyor 12 and 14 can be utilized to convey the lumber through the kiln 1. Preferably, the first conveyor 12 comprises a set of rails upon which a first carriage 16 having wheels 20 rides, and the second conveyor 14 comprises a set of rails upon which a second carriage 18 having wheels 20 rides. The first carriage 16 holds a first charge of green lumber 22 and is pushed on the rails by a pusher device 28. The second carriage 18 holds a second charge of green lumber 24 and pushed on rails by another pusher device 28. The first conveyor 12 conveys the green lumber 22 through the kiln 1 in the following order, through first entry opening 4 into the first treatment chamber 62, the first heat transfer chamber 64, the first heating chamber 52, the second heating chamber 54, the second heat transfer chamber 68, second treatment chamber 70, and then out the second entry opening 8. The second conveyor 14 conveys the green lumber 24 through the kiln 1 in a direction opposite the first conveyor 12, in the following order, into the second kiln opening 8 into the second treatment chamber 70, the second heat transfer chamber 68, the second heating chamber 54, the first heating chamber 52, the first heat transfer chamber 64, the first treatment chamber 62 and then out the first kiln opening 4. Once the green lumber 22 leaves the central chamber 2 it is considered dry lumber 25. Once the green lumber 24 leaves the central chamber 2 it is considered dry lumber 26.

The first end chamber 6 has at least one external first end fan 40 configured to provide a first end flow of air in the first end chamber 6. The fan 40 is preferably a centrifugal fan having an inlet 42 and outlet 44. The centrifugal fan 40 is unidirectional and non-reversible. Preferably, the first end chamber 6 has at least two fans 40 so that if one fan 40 is offline for repair or maintenance the other fan(s) 40 can continue to provide necessary air flow. The fan 40 is preferably configured to provide the first end flow of air in the direction from the dry lumber 26 on the second conveyor 14 towards the green lumber 22 on the first conveyor 12. As shown in the FIGS. 1-6, the fan 40 can blow air through the outlet 44 above the first and second conveyors 12 and 14, where the air flow will descend and then flow through the dry lumber 26 on the second conveyor 14, then through the green lumber 22 on the first conveyor 12 and into the inlet 42 of the fan 40 to transfer heat from the dry lumber 26 leaving the central chamber 2 to the green lumber 22 entering the central heating chamber 2. The fans 40 are preferably centrifugal type fans that cannot change the direction of the air flow.

The second end chamber 10 has at least one external first end fan 40 configured to provide a second end flow of air in the second end chamber 10. The fan 40 is preferably a centrifugal fan having an inlet 42 and outlet 44. The centrifugal fan 40 is unidirectional and non-reversible. Preferably, the first end chamber 10 has at least two fans 40 so that if one fan 40 is offline for repair or maintenance the other fan(s) 40 can continue to provide necessary air flow. The fan 40 is preferably configured to provide the second end flow of air in the direction from the dry lumber 25 on the first conveyor 12 towards the green lumber 24 on the second conveyor 14. As shown in the FIGS. 1-6, the fan 40 can blow air through the outlet 44 above the first and second conveyors 12 and 14, where the air flow will descend and then flow through the dry lumber 25 on the first conveyor 12, then through the green lumber 24 on the second conveyor 14 and into the inlet 42 of the fan 40 to transfer heat from the dry lumber 25 leaving the central heating chamber 2 to the green lumber 24 entering the central heating chamber 2. The fans 40 are preferably centrifugal type fans that cannot change the direction of the air flow.

The central heating chamber 2 has at least one fan 40 to provide a heating air flow. Preferably, each of the first and second heating chambers 52 and 54 have associated fans 40. As shown in FIGS. 1-6, a first heating chamber fan 40 is preferably configured to provide a first heating air flow in the first heating chamber 52 so that the first heating air flows out of the outlet 44 above the first and second conveyors 12 and 14, descends and flows through the lumber 22 on the on the first conveyor 12 and then flows through the lumber 24 on the second conveyor 14 and into the inlet 42 of the first heating chamber fan 40. A second heating chamber fan 40 is preferably configured to provide a second heating air flow in the second heating chamber 54 so that the second heating air flows out of the outlet 44 above the first and second conveyors 12 and 14, descends and flows through the lumber 24 on the on the second conveyor 14 and then flows through the lumber 22 on the first conveyor 12 and into the inlet 42 of the second heating chamber fan 40.

The fans 40 are preferably centrifugal fans. The centrifugal fan is now well-known and any suitable centrifugal fan can be utilized. The centrifugal fan is a mechanical device for moving air and/or other gases. The fan increases the speed and volume of an air stream with the rotating impellers. Centrifugal fans use the kinetic energy of the impellers to increase the volume of the air stream, which in turn moves them against the resistance caused by ducts, dampers and other components. Centrifugal fans displace air radially, changing the direction (typically by 90°) of the airflow. They are sturdy, quiet, reliable, and capable of operating over a wide range of conditions. Centrifugal fans are constant displacement devices or constant volume devices. meaning that, at a constant fan speed, a centrifugal fan moves a relatively constant volume of air rather than a constant mass. This means that the air velocity in a system is fixed even though the mass flow rate through the fan is not. The centrifugal fan is a drum shape comprising a number of fan blades mounted around a hub (impeller). The hub turns on a driveshaft mounted in bearings in the fan housing. The air/gas enters from the side of the fan wheel, turns 90 degrees and accelerates due to centrifugal force as the air/gas flows over the fan blades and exits the fan housing. The direction of flow through the centrifugal fan cannot be reversed. Examples of centrifugal fans that can be utilized comprise a model IAP Size 600 'B' Class II fan, 65,000 CFM, operating speed 509-, 40 HP motor. Another example is an IAP Size 730 'A' Class II fan, 110,000 CFM, operating speed 440 RPM, 60 HP motor.

Different horsepower/sized fans may be used in different zones to controllably vary the rate of air flow through the lumber charges. The baffles 7, 9 and dividers 50, 60, 66 help prevent migration of air velocity and help maintain air differentials between the zones. In one embodiment, the higher air velocity is generated in the zones at or near the center of the kiln 1. The air velocity may be gradually reduced in the zones towards the entry/discharge ends of the kiln 1.

The kiln 1 can be operated such that a continuous dried lumber charge 26 exits the first opening 4 of the kiln 1 while a continuous green lumber charge 22 enters the first opening 4, and at the opposite end of the kiln 1 a continuous dried lumber charge 25 exits the second opening 8 of the kiln 1 while a continuous green lumber charge 24 enters the second opening 8.

Embodiments allow for the heat dissipating from the dried lumber 25, 26 after exiting the central heating chamber 2 to heat or preheat the green lumber 22, 24 in the end chambers 6, 10, thereby saving time and energy over the batch kiln systems. Embodiments also include the green lumber 22, 24 releasing moisture into the air due to the heating by the dried charge 25, 26, which cools the air and may assist in conditioning the dried lumber 25, 26 prior to exiting the kiln 1.

The kiln 1 includes a heater 120 for heating any of the chambers 2, 6 and 10. The heater can provide direct and/or indirect heat as desired. Heaters 120 are now well-known and any desired heater can be utilized. The heater 120 can be located outside of the kiln 1 and can supply heated air through an associated fan and duct system to the central heating chamber 2, and/or any other part of the kiln 1 as desired.

The kiln 1 can include a computer system 100 to control the operation of the kiln 1, including speed of the pushers 28, speed of the fans 20, conditions in the chambers 2, 6 and 10, such as temperature and humidity, and any other operations as desired. Computer systems 100 and associated controls are now well known and any desired computer system 100 and control can be utilized in the kiln 1 as desired.

Embodiments of the present invention are directed to a continuous type lumber drying process, where, in FIGS. 1-6, at least two different opposing paths 12 and 14 move green lumber 22 and 24 in opposite directions through a kiln 1. Embodiments allow for the heat dissipating from the dried lumber 25, 26 after exiting the central heating chamber 2 to heat or preheat the green lumber 22, 24 in the end chambers 6, 10, thereby saving time and energy over the batch kiln systems. Embodiments also include the green lumber 22, 24 releasing moisture into the end chambers 6, 10 due to the heating by the dried lumber 25, 26, which cools the air and may assist in conditioning the dried lumber 25, 26 prior to exiting the kiln.

Preferably the green lumber charges 22, 24 loaded on the carriages 16, 18 and are moved in opposite directions at rates appropriate to drying characteristics of the lumber products comprising the charge through the kiln 1 using pushers 28, and are controllably moved at a rate calculated to ensure that the proper drying of a green charges 22, 24 is achieved from the time it enters one end 4 or 8 and exits the opposite end 4 or 8 of the kiln 1. Multiple carriages 16, 18, may be linked together in such a way that they can be pushed by pushers 28 to effect the desired movement with the pushing being effective to eliminate or reduce spaces between the carriages when several carriages 16, 18 are being used.

The construction, dimensions, sizing and control of the chambers 2, 6 and 10, carriages 16, 18, and pusher devices 28 can be as conventionally used in known dual path kilns 1. The present dual path kiln 1 is an improvement over conventional dual path kilns. In the present kiln 1, more efficient centrifugal fans external to the kiln are utilized. It was not known prior to the present invention that unidirectional and external fans, like the centrifugal fans, can be utilized in a dual path kiln 1. It was believed that internal propeller type fans were required so that the air flow directions could be periodically reversed. Applicant has found that surprisingly, consistent circular air flows through the lumber can be utilized to effectively and more efficiently dry lumber in a dual path kiln 1, without having to reverse the air flow direction. However, the air flow directions, number of the air flows, placement of the air flows and velocities described herein and shown in the drawings are exemplary and any flow direction, number of air flows, placement of air flows and velocities can be utilized as desired for the particular kiln application.

Figure 5:
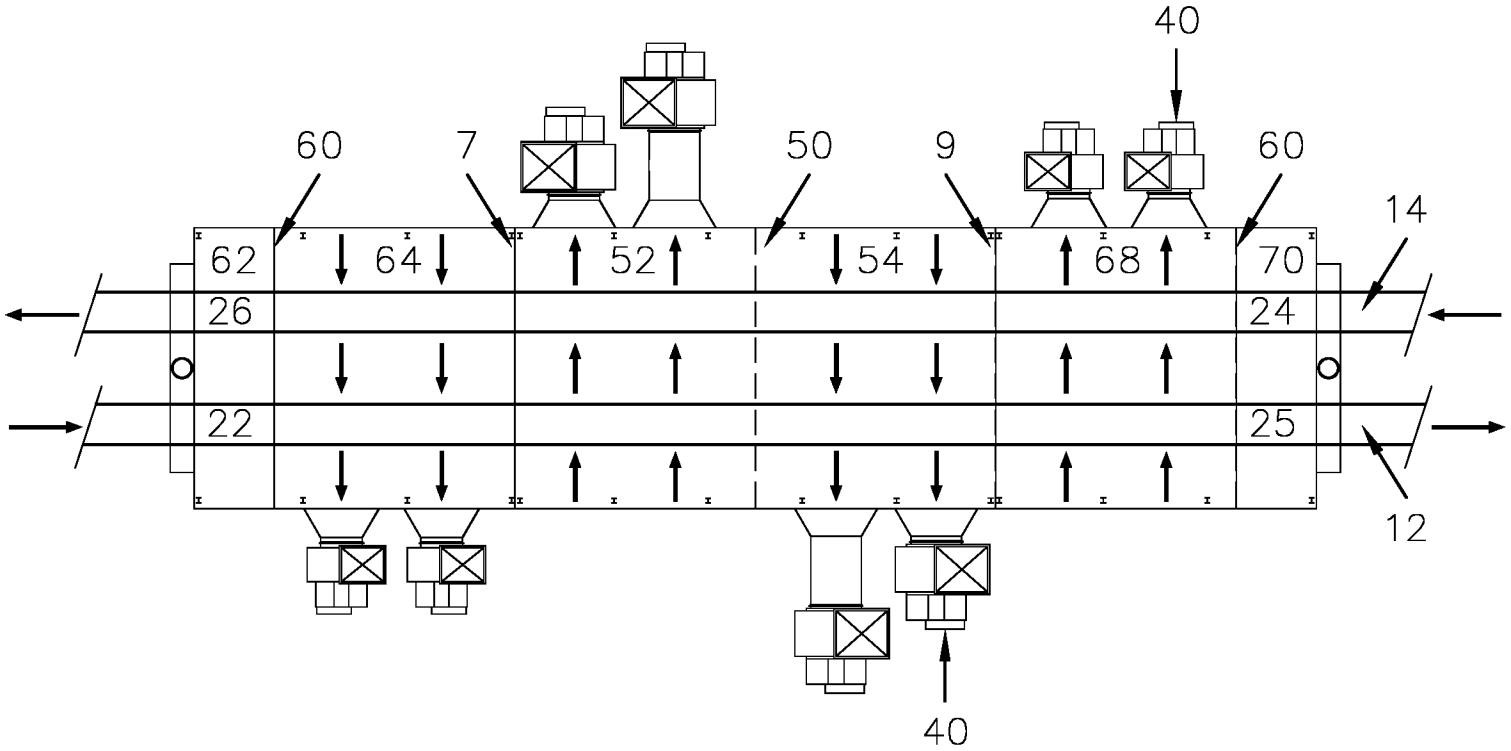
FIG. 5 illustrates a top view of the air flow through the lumber in an exemplary kiln.
Figure 6:
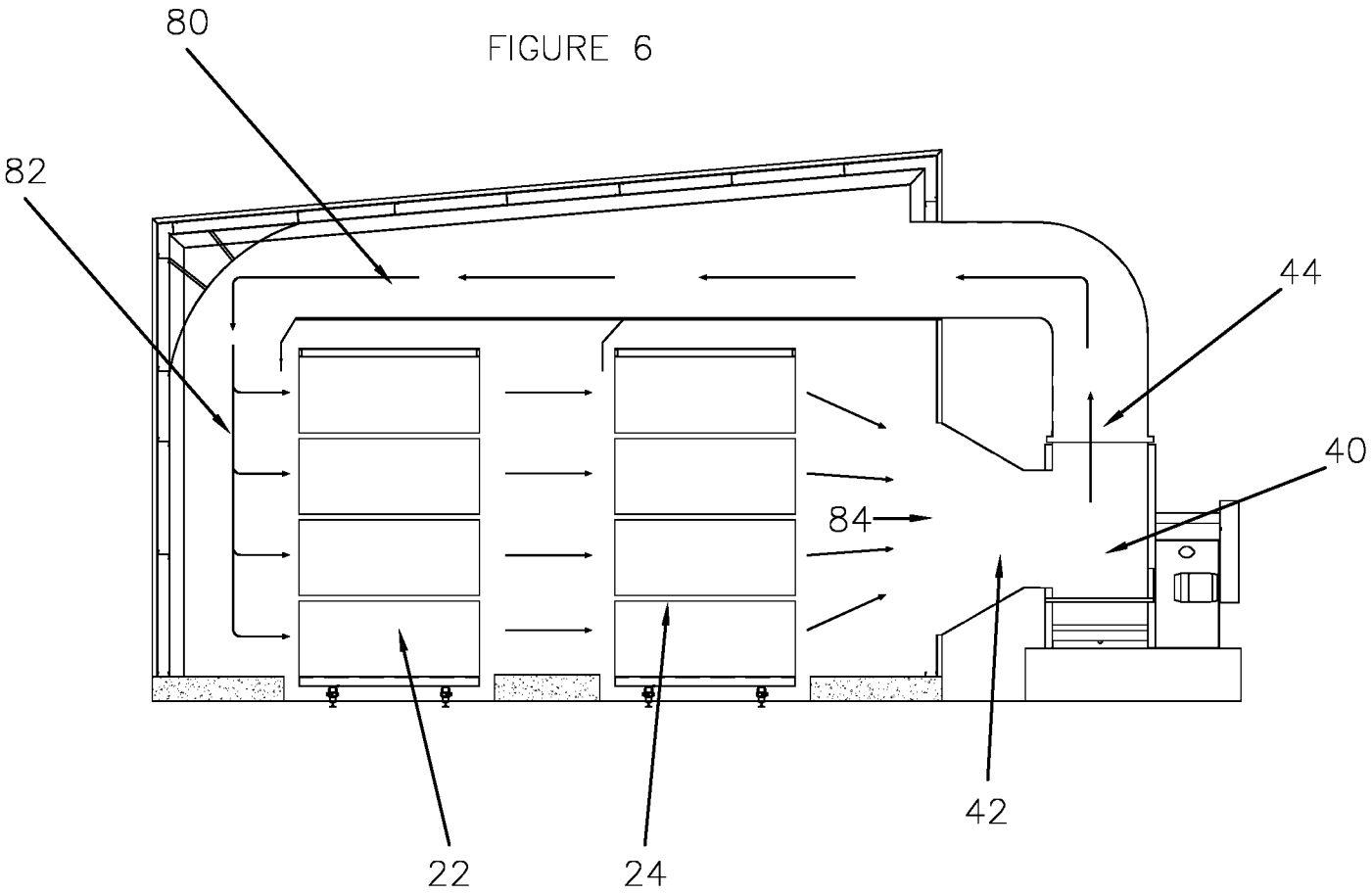
FIG. 6 illustrates a side view of the air flow through the lumber in an exemplary kiln.

FIGS. 5 and 6 illustrate examples of air flow through the lumber. FIG. 6 shows a circular air flow in which air flows through the lumber 22, then lumber 24 (also lumber 25, 26 in other chambers), then through the chamber exit 84 into the fan inlet 42, out the fan outlet 44, through the overhead duct 80 that moves the air over the lumber 22, 24, out the duct exit 82, descends and goes back through the lumber 22, then lumber 24 to repeat the circular flow.

Conventional dual path kilns can now be upgraded with the external unidirectional fans 40, ducting and control systems as described herein to provide unexpectedly improved lumber drying rates and thus lumber drying cost savings.

If desired, additional ducts and valves can be added so that fans can be connected to more than one chamber, so that if one fan is shut down another fan can be utilized to provide air flow elsewhere in the kiln 1. Preferably, there is little or no air flow in the first and second treatment chambers 62 and 70.

A preferred method of continuously drying lumber using the kiln 1 comprises pushing a charge of green lumber 22 into the opening 4 into the first treatment chamber 62, the first heat transfer chamber 64, the first heating chamber 52, the second heating chamber 54, the second heat transfer chamber 68, second treatment chamber 70, and then dry lumber 25 out the second entry opening 8. The method also comprises pushing a charge of green lumber 24 through the kiln 1 in a direction opposite the first conveyor 12, in the following order, into the second kiln opening 8 into the second treatment chamber 70, the second heat transfer chamber 68, the second heating chamber 54, the first heating chamber 52, the first heat transfer chamber 64, the first treatment chamber 62 and then dry lumber 26 out the first kiln opening 4.

As the green lumber charges 22, 24 pass the dried lumber charges 25, 26 in the end chambers 6, 10, the dried charges 25, 26 heat the air in the end chambers 6, 10. This heating effect in turn can heat the green lumber 22, 24, thereby gradually raising the temperature encountered by the green lumber 22, 24 and initiate the drying process of the green lumber. Likewise, as the green lumber 22, 24 begins to dry, it can release moisture into the air of end chambers 6, 10. This moisture release may cool the air and increase the humidity of the air.

The kiln 1 can be vented through the open ends 4, 8. Alternatively, one or more vents may be positioned in any of the fan outlet ducts 44 to controllably regulate the temperature and manage any condensation or moisture congregation that can occur.

The travel time of the lumber charges 22, 24 through the kiln 1 may vary depending on many of the same factors affecting the batch kiln process. When using a continuous drying process in accordance with embodiments of the present invention, the length of time for the lumber 22, 24 to pass through the kiln 1 and be dried to a desired moisture content can be similar to the typical batch kiln process for analogous species and dimensions. It is preferred that the travel rates the charges 22, 24 pass through the kiln at collectively or independently varying rates depending on the rate of drying for the lumber products that comprise the charge, but opposite in direction. Accordingly, the moisture content of the lumber charges being dried can monitored by the computer system 100, and the pusher 28 rate as reflected in the velocity of the carriages 16, 18 traveling on rails in each path 12 and 14 can be altered as needed to ensure the dried lumber charges 25, 26 exit the kiln at the proper moisture content.

Examples

The invention will be further explained by the following non-limiting exemplary processes.

In an example, the environment in the treatment chambers 62 and 70 is saturated, with both the wet bulb (WB) temp and the dry bulb (DB) temp at about 100 to 120° F. As the green lumber 22, 24 moves through the first 10 feet of the treatment chambers 62 and 70, the DB and WB temps rapidly increase to about 150 to 160° F. As the charges 22, 24 leave the initial 10' of the treatment chambers 62, 70, the DB temp increases linearly through the heat transfer chambers 64, 68, and the WB temp remains essentially the same. At the transition from the heat transfer chambers 64, 68 to the center chambers 52, 54, the DB temp is ~190° F.-200° F., and the WB temp is ~150° F.-160° F. When the lumber 22, 24 enters the center chambers 52, 54, the DB temp immediately increases to the kiln set point temp (~210° F.-260° F.), while the WB temp remains at the same temp as it was upon reaching the center chamber 2. These temps remain essentially constant as the lumber 22, 24 makes its way through the entire center chamber 2. The green lumber 22, 24 becomes dry lumber 35, 26 upon leaving the center chamber 2.

Relative Humidity for each chamber: In the treatment chambers 62, 70, the environment in the kiln is saturated, and the Relative Humidity is about 100%. As the lumber 22, 24 moves through the first about 10 feet of the kiln 1 in the treatment chambers 62, 70, the Relative Humidity remains at about 100%. As the lumber 22, 24 leaves the treatment chambers 62, 70, the relative Humidity decreases linearly through the remainder of the chamber, and at the transition from the initial end chamber 6, 10 to the center chamber 1, the Relative Humidity is about 60-70%. When the lumber 22, 24 enters the central heating chamber 2, the Relative Humidity immediately decreases to about 20-30%. These humidity conditions remain essentially constant as the lumber 22, 24 makes its way through the entire center chamber 2.

Circulation air flows shown in FIGS. 5 and 6: In the treatment chambers 62, 70, there are no circulation fans directly affecting the environment so disruptions in air flow through the lumber 22, 24 are negligible. As the lumber 22, 24 leaves the treatment chamber 62, 70 and enter the heat transfer chambers 64, 68, the circulation fans 40 move the air through lumber, preferably in the direction from the dried lumber 26 to the green lumber 22 and from the dried lumber 25 to the green lumber 24, at sticker velocities of 400-500 fpm. When the lumber 22, 24 enters the central heating chamber 2, the circulation air flow remains in a direction of the green lumber 22 to the green lumber 22 in the center chamber 52 and green lumber 24 to the green lumber 22 in the center chamber 54, but the sticker velocities increase to 1,100-1,200 fpm. These air flows remain essentially constant as the lumber 22, 24 travels through the central heating chamber.

Lumber Indexing rate ranges: Indexing rate is related to the dimensional characteristics of the lumber 22, 24 being dried in that lumber 22, 24 exhibiting "high total surface area to volume" ratios index faster than lumber 22, 24 with lower ratios. Indexing rate is also directly related to the overall length of the central heating chamber 2 of the kiln 1, inasmuch as the total residence time of the lumber 22, 24 in the central heating chamber 2 of the kiln 1 is constant irrespective of central heating chamber 2 length. As such, longer central heating chamber 2 kilns exhibit higher pack indexing rates. Indexing rate, is related to the DB set point temp of the kiln 1, as higher set point temps yield higher indexing rates. Indexing rates can vary from about 1 foot per hour to about 10 feet per hour travel of the lumber 22, 24 on the conveyors 12, 14, depending on the factors outlined above.

It is not an obvious design choice to replace internal reversible propeller fans with external unidirectional fans. The prior art kilns require periodic reversal of the flow directions, which could only be accomplished with the internal reversible propeller fans. It has now been surprisingly found that faster and improved drying of the lumber can be accomplished by a new structure of the kiln using constant air flow directions in which reversible fans are no longer required. Thus, the external single direction fans can now be utilized in place of conventional reversible fans.

The fans preferably provide a circular air flow through the lumber and above the lumber as shown in FIG. 6. Preferably, the circular air flow through the lumber and above the lumber provided by the fans is not reversed as the lumber passes through the first and second end chambers, i.e. the fan is not reversed and valves are not used to reverse the air flow. Preferably, the circular air flow through the lumber and above the lumber provided by the fans is not reversed as the lumber passes through the central heating chamber.

A major difference between the present invention and the Counterflow Dual Path Kiln disclosed in U.S. Pat. No. 7,963,048 (Pollard) Pollard include the circulation air direction in the present kiln 1 is not required to reverse. In the prior art, the air flow through the lumber is periodically reversed. In an example of the present method, for the entire length of the kiln—the circulation air flow directions do not ever change in the partitioned chambers. Because the air flows are not required to reverse, the circulation fans are not typical propeller type fans located internal to the kiln and above the fan deck, but rather are centrifugal type fans that are external to the kiln structure, have a far higher efficiency, are fewer in number and can be located at ground level. Prior to the present invention, centrifugal fans have not been used to generate circulation air in a dual path continuous kiln.

Figure 7:
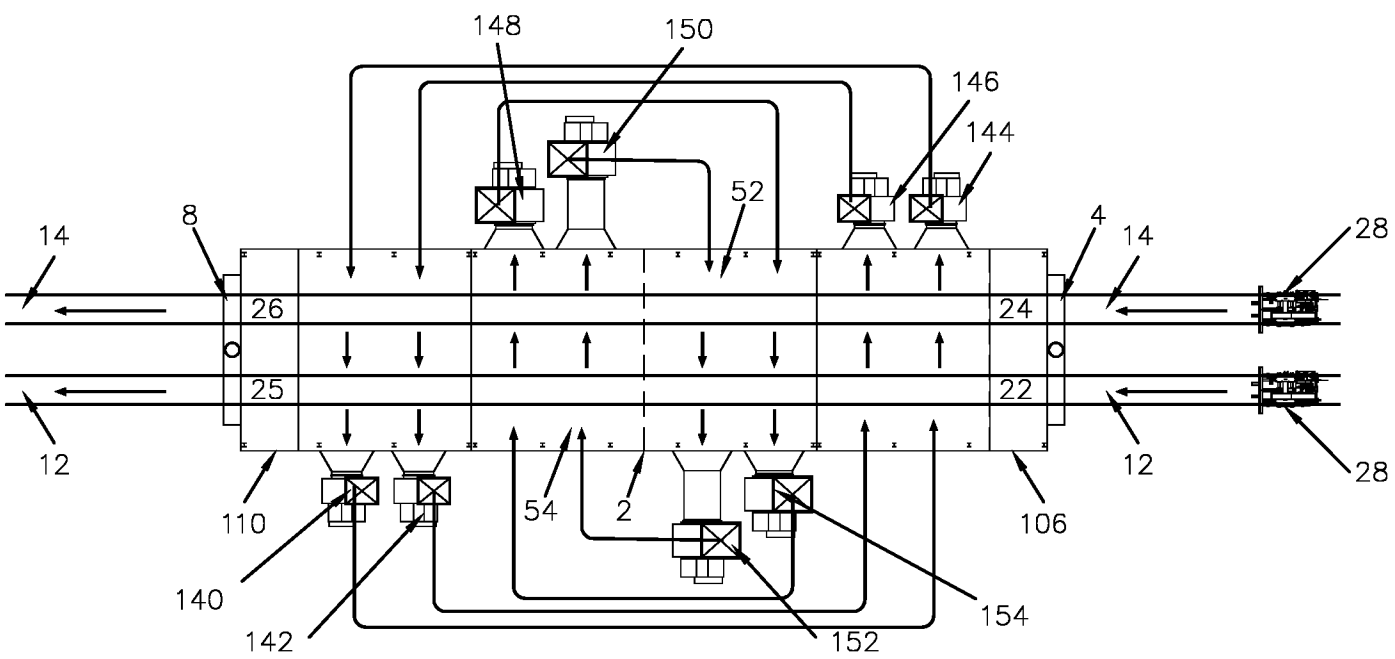
FIG. 7 illustrates a top view of an alternative embodiment of the kiln.

FIG. 7 illustrates a non-limiting example of an alternative embodiment. As shown in FIG. 7, the kiln 1 can be operated so that the lumber conveyors 12 and 14 convey the lumber in the same direction, as shown in FIG. 7, with green lumber 22 on the first conveyor 12 and green lumber 24 on the second conveyor 14. The green lumber 22 and 24 are conveyed into a first kiln opening 4, into a first end chamber 106, the first central chamber 52, the second central chamber 54, the second end chamber 110 and out a second kiln opening 8. Upon leaving the second central chamber 54, the green lumber 22 and 24 are considered dry lumber 25 and 26. The desired air transfer can be accomplished with cross-over ducts linking the fans 40 (individually labeled 140, 142, 144, 146, 148, 150, 152, and 154) to the chambers. In FIG. 7, the chambers 2, 102, 106 may have a similar construction as in FIG. 1-6. However, overhead ducts 80 are not required in this embodiment. The location of the fans 40 and fan inlets 42 in FIGS. 1-6 has remained substantially the same as in the embodiment of FIG. 7. However, the fan outlets 44 are now changed with air flowing from the fan outlets 44 being moved to different locations in the kiln 1. For example, in this alternative embodiment, moisture from the green lumber 22, 24 in the first end chamber 106 can be supplied to dry lumber 25, 26 in the second end chamber 110 and heat from the dry lumber 25, 26 in the second end chamber 110 can be supplied to the green lumber 22, 24 in the first end chamber 106 using circular air flows. In the central chamber 2, a circular air flow between the first center chamber 52 and the second center chamber 54 is used to dry the green lumber 22 and 24 in the center chamber 2. Only one lumber conveyor is necessary to operate this embodiment if the travel rates for both charges as dictated by the drying characteristics of the lumber products comprising them are the same. However, two or more lumber conveyors can be utilized if varying charge rates are required. The invention is not limited to the specific air flows shown in the drawings.

The first end chamber 106 has two associated first end chamber fans 144 and 146, having inlets into the first end chamber 106, so that the air flows through the green lumber 22, then through the green lumber 24, and then into the inlets of the fans 144, 146. The second end chamber 110 has two associated second end chamber fans 140, 142, having inlets into the first end chamber 110, so that the air flows through the second dry lumber 26, then through the first dry lumber 25, then into the inlets of the fans 140, 142. The outlets of the fans 140, 142 flow air from the second end chamber 110 to the first end chamber 106. The outlets of the fans 144, 146 flow air from the first end chamber 106 to the second end chamber 110. In this manner, the fans 140, 142, 144 and 146 provide a circular air flow through the lumber in the first end chamber 106 and second end chamber 110. Ducts are now well known and any desired ducts can be utilized to provide the air between the fans 140, 142, 144 and 146 and the chambers 106, 110.

The first center chamber 52 has two associated first center chamber fans 152, 154, having inlets into the first center chamber 52, so that the air flows through the second green lumber 24, then through the first green lumber 22, then into the inlets of the fans 152, 154. The second center chamber 54 has two associated second center chamber fans 148, 150, having inlets into the second center chamber 54, so that the air flows through the first green lumber 22, then through the second green lumber 24, then into the inlets of the fans 148, 152. The outlets from the fans 148, 150 flow air from the second central chamber 54 to the first central chamber 52. The outlets of the fans 152, 154 flow air from the first central chamber 52 to the second central chamber 54. In this manner, the fans 148, 150, 152, and 154 provide a circular air flow through the lumber in the first central chamber 52 and second central chamber 54. Ducts are now well known and any desired ducts can be utilized to provide the air flows between the fans 148, 150, 152 and 154 and the chambers 52, 54.

The invention will be further described with reference to the following Examples. Since the circulating air flow occurs solely within the chamber it is serving and moves outside of the kiln structure proper and passes through ducting into and out of the centrifugal fan, this makes it much more practical to install a conventional very early warning fire protection systems (an example of which is an aspirating smoke detection system, see: https://www.systemsensor.com/en-us/_layouts/ss/search.aspx?k= Aspiration-Conventional-Detectors). Prior art dual path kilns do not have this chambered air flow, nor do they have provisions for ready access to the flow outside the kiln structure proper.

In a prior art dual path kiln, when the fans reverse, the circulating air flow stops briefly (2-5 minutes) and does not return to optimum velocities for significantly longer than that, so in addition to "not drying" in that interval, the heat load required of the heating system for the kiln drops dramatically and the temperature in the kiln rises significantly (~50-70 degrees F.). Without being bound by any theory, it is believed that when drying pine lumber, the emission rate of hazardous compounds as defined by the EPA (Volatile organics—"VOC's"—and non-criteria Hazardous air pollutants—"HAP's"—formaldehyde and methanol) rise dramatically . . . when the fans don't reverse, the temperature spikes are eliminated and kiln emission levels unexpectedly drop. Another significant benefit from not reversing the fans is that since fan reversals are not occurring, the heat load for the kiln remains very consistent and the heat source can surprisingly be operated at a much higher level of efficiency. In direct heated (i.e slope grate sawdust burner) kilns, the more consistent demand for heat is especially beneficial as direct heated kilns do not react to rapid changes in heat load well.

Emission and production testing was conducted at Charles Ingram to compare their prior art kiln #5 (conventional DPK) to the present invention kiln #6 (NOREV DPK). During the emissions testing, drying productivity was tracked. The "time lost drying" due to fan reversals in a conventional DPK, or the increase in drying rate from a NOREV DPK was a surprising and unexpected 10%. Emissions testing comparing the two kilns was also conducted. To summarize NOREV DP Kiln #6 according to the present invention exhibited numerous unexpected and surprising advantages compared to the prior art DP Kiln 5. For the HAP formaldehyde, NOREV DP Kiln #6 emission levels were a surprising and unexpected 20% lower than DP Kiln #5. For the HAP methanol, NOREV DP Kiln #6 emissions levels were a surprising and unexpected 20% lower than DP Kiln #5. For the criteria pollutant VOC's, NOREV DP Kiln #6 emission levels were a surprising and unexpected 59% lower than DP Kiln #5.

Table 1 lists the Dual path continuous kiln specifics for the prior art Kiln #5.

TABLE 1

| Kiln 5 DPK (Prior Art) Dual Path Continuous Kiln Specifics | |
|---|---|
| DP kiln central chamber length (feet) | 56 |
| DP kiln end chambers length (feet) | 37 |
| Kiln dry bulb operating Temp (° F.) - Entering Air | 245 |
| Board feet dried/hour per lineal foot of kiln center chamber | 119.6 |
| Board feet dried/hour per lineal foot of total kiln | 51.5 |

Table 2 lists the Dual path continuous kiln process data results for the prior art Kiln #5.

TABLE 2

| Kiln 5 Test Run 1 Process Data | | |
|---|---|---|
| Product Designation | 5/4 | 4 Timbers |
| Nominal thick (inches) | 1.25 | 4 |
| Nominal width (inches) | 6 | 4 |
| Green thickness (inches) | 1.220 | 4.000 |
| Green width (inches) | 6.000 | 4.000 |
| Board feet/piece/lineal foot | 0.63 | 1.33 |
| Pieces/layer | 16 | 24 |
| Minimum pack width (foot) | 8.00 | 8.00 |
| Layers/sawmill pack | 19 | 8 |
| Packs/kiln bunk | 4 | 4 |
| Number pieces per kiln bunk | 1216 | 768 |
| Board foot/lineal foot of kiln bunk | 760.0 | 1024.0 |
| Test Interval Pusher rate (feet/hour) | 6.625 | 1.625 |
| Test begin | Nov. 28, 2018 12:50 PM | Nov. 28, 2018 12:50 PM |
| Test end | Nov. 28, 2018 1:55 PM | Nov. 28, 2018 1:55 PM |
| Production drying rate (board feet/hour) | 5,035.0 | 1,664.0 |
| Test duration (hours) | 1.083 | 1.083 |
| Board footage lumber dried in test duration | 5,454.6 | 1,802.7 |
| Kiln drying rate (board feet/hour) | 6,699.0 | |
| Total test duration board feet dried | 7,257.3 | |

Table 3 lists the Dual path continuous kiln process data results for the prior art Kiln #5.

TABLE 3

| Kiln 5 Test Run 2 Process Data | | |
|---|---|---|
| Product Designation | 5/4 | 4 Timbers |
| Nominal thick (inches) | 1.25 | 4 |
| Nominal width (inches) | 6 | 4 |
| Green thickness (inches) | 1.220 | 4.000 |
| Green width (inches) | 6.000 | 4.000 |
| Board feet/piece/lineal foot | 0.63 | 1.33 |
| Pieces/layer | 16 | 24 |
| Minimum pack width (foot) | 8.00 | 8.00 |
| Layers/sawmill pack | 19 | 8 |
| Packs/kiln bunk | 4 | 4 |
| Number pieces per kiln bunk | 1216 | 768 |
| Board foot/lineal foot of kiln bunk | 760.0 | 1024.0 |
| Test Interval Pusher rate (feet/hour) | 6.625 | 1.625 |
| Test begin | Nov. 28, 2018 2:20 PM | Nov. 28, 2018 3:25 PM |
| Test end | Nov. 28, 2018 2:20 PM | Nov. 28, 2018 3:25 PM |
| Production drying rate (board feet/hour) | 5,035.0 | 1,664.0 |
| Test duration (hours) | 1.083 | 1.083 |
| Board footage lumber dried in test duration | 5,454.6 | 1,802.7 |
| Kiln drying rate (board feet/hour) | 6,699.0 | |
| Total test duration board feet dried | 7,257.3 | |

Table 4 lists the Dual path continuous kiln process data results for the prior art Kiln #5.

TABLE 4

| Kiln 5 Test Run 3 Process Data | | |
|---|---|---|
| Product Designation | 5/4 | 4 Timbers |
| Nominal thick (inches) | 1.25 | 4 |
| Nominal width (inches) | 6 | 4 |
| Green thickness (inches) | 1.220 | 4.000 |
| Green width (inches) | 6.000 | 4.000 |
| Board feet/piece/lineal foot | 0.63 | 1.33 |
| Pieces/layer | 16 | 24 |
| Minimum pack width (foot) | 8.00 | 8.00 |
| Layers/sawmill pack | 19 | 8 |
| Packs/kiln bunk | 4 | 4 |
| Number pieces per kiln bunk | 1216 | 768 |
| Board foot/lineal foot of kiln bunk | 760.0 | 1024.0 |
| Test Interval Pusher rate (feet/hour) | 6.625 | 1.625 |
| Test begin | Nov. 28, 2018 3:55 PM | Nov. 28, 2018 4:59 PM |
| Test end | Nov. 28, 2018 3:55 PM | Nov. 28, 2018 4:59 PM |
| Production drying rate (board feet/hour) | 5,035.0 | 1,664.0 |
| Test duration (hours) | 1.067 | 1.067 |
| Board footage lumber dried in test duration | 5,370.7 | 1,774.9 |
| Kiln drying rate (board feet/hour) | 6,699.0 | |
| Total test duration board feet dried | 7,145.6 | |

Table 5 lists the Dual path continuous kiln specifics for the Kiln #6 operated according to the present invention.

TABLE 5

| Kiln 6 (Present Invention) Dual Path Continuous Kiln (DPK) Specifics | |
|---|---|
| DP kiln central chamber length (feet) | 60 |
| DP kiln end chambers length (feet) | 40 |
| Kiln dry bulb operating Temp (° F.) - Entering Air | 245 |
| Board feet dried/hour per lineal foot of kiln center chamber | 131.3 |
| Board feet dried/hour per lineal foot of total kiln | 56.3 |

Table 6 lists the Dual path continuous kiln process data results for the Kiln 6 according to the present invention.

TABLE 6

| Kiln 6 Test Run 1 Process Data | | |
|---|---|---|
| Product Designation | 5/4 | 4 Timbers |
| Nominal thick (inches) | 1.25 | 4 |
| Nominal width (inches) | 6 | 4 |
| Green thickness (inches) | 1.220 | 4.000 |
| Green width (inches) | 6.000 | 4.000 |
| Board feet/piece/lineal foot | 0.63 | 1.33 |
| Pieces/layer | 16 | 24 |
| Minimum pack width (foot) | 8.00 | 8.00 |
| Layers/sawmill pack | 19 | 8 |
| Packs/kiln bunk | 4 | 4 |
| Number pieces per kiln bunk | 1216 | 768 |
| Board foot/lineal foot of kiln bunk | 760.0 | 1024.0 |
| Test Interval Pusher rate (feet/hour) | 7.750 | 1.940 |
| Test begin | Nov. 27, 2018 9:55 AM | Nov. 27, 2018 9:55 AM |
| Test end | Nov. 27, 2018 11:00 AM | Nov. 27, 2018 11:00 AM |
| Production drying rate (board feet/hour) | 5,890.0 | 1,986.6 |
| Test duration (hours) | 1.083 | 1.083 |
| Board footage lumber dried in test duration | 6,380.8 | 2,152.1 |
| Kiln drying rate (board feet/hour) | 7,876.6 | |
| Total test duration board feet dried | 8,532.9 | |

Table 7 lists the Dual path continuous kiln process data results for the Kiln #6 according to the present invention.

TABLE 7

| Kiln 6 Test Run 2 Process Data | | |
|---|---|---|
| Product Designation | 5/4 | 4 Timbers |
| Nominal thick (inches) | 1.25 | 4 |
| Nominal width (inches) | 6 | 4 |
| Green thickness (inches) | 1.220 | 4.000 |
| Green width (inches) | 6.000 | 4.000 |
| Board feet/piece/lineal foot | 0.63 | 1.33 |
| Pieces/layer | 16 | 24 |
| Minimum pack width (foot) | 8.00 | 8.00 |
| Layers/sawmill pack | 19 | 8 |
| Packs/kiln bunk | 4 | 4 |
| Number pieces per kiln bunk | 1216 | 768 |
| Board foot/lineal foot of kiln bunk | 760.0 | 1024.0 |
| Test Interval Pusher rate (feet/hour) | 7.750 | 1.940 |
| Test begin | Nov. 27, 2018 11:45 AM | Nov. 27, 2018 11:45 AM |
| Test end | Nov. 27, 2018 1:38 PM | Nov. 27, 2018 1:38 PM |

TABLE 7-continued

| Kiln 6 Test Run 2 Process Data | | |
|---|---|---|
| Production drying rate (board feet/hour) | 5,890.0 | 1,986.6 |
| Test duration (hours) | 1.883 | 1.883 |
| Board footage lumber dried in test duration | 11.092.8 | 3,741.4 |
| Kiln drying rate (board feet/hour) | 7,876.6 | |
| Total test duration board feet dried | 14,834.2 | |

Table 8 lists the Dual path continuous kiln process data results for the Kiln #6 according to the present invention.

TABLE 8

| Kiln 6 Test Run 3 Process Data | | |
|---|---|---|
| Product Designation | 5/4 | 4 Timbers |
| Nominal thick (inches) | 1.25 | 4 |
| Nominal width (inches) | 6 | 4 |
| Green thickness (inches) | 1.220 | 4.000 |
| Green width (inches) | 6.000 | 4.000 |
| Board feet/piece/lineal foot | 0.63 | 1.33 |
| Pieces/layer | 16 | 24 |
| Minimum pack width (foot) | 8.00 | 8.00 |
| Layers/sawmill pack | 19 | 8 |
| Packs/kiln bunk | 4 | 4 |
| Number pieces per kiln bunk | 1216 | 768 |
| Board foot/lineal foot of kiln bunk | 760.0 | 1024.0 |
| Test Interval Pusher rate (feet/hour) | 7.750 | 1.940 |
| Test begin | Nov. 27, 2018 2:05 PM | Nov. 27, 2018 2:05 PM |
| Test end | Nov. 27, 2018 3:14 PM | Nov. 27, 2018 3:14 PM |
| Production drying rate (board feet/hour) | 5,890.0 | 1,986.6 |
| Test duration (hours) | 1.150 | 1.150 |
| Board footage lumber dried in test duration | 6,773.5 | 2,284.5 |
| Kiln drying rate (board feet/hour) | 7,876.6 | |
| Total test duration board feet dried | 9,058.0 | |

The test results demonstrate a drying productivity improvement of the present invention Kiln #6 over the prior art Kiln #5 of an unexpected and surprising 110%.

In addition to the discussion of various embodiments above, figures and additional discussion are presented herein to further describe certain aspects and various embodiments of the present invention. It is to be understood, however, that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein.

We claim:

1. A continuous kiln comprising:

a first end chamber having a first kiln opening;

a second end chamber having a second kiln opening;

a central heating chamber connecting the first end chamber to the second end chamber;

a first lumber conveyor configured to continuously convey a first green lumber in a first lumber direction into the first kiln opening, the first end chamber, the central heating chamber, the second end chamber, and convey a first dried lumber out the second end chamber;

a second lumber conveyor configured to continuously convey a second green lumber in a second lumber direction opposite the first lumber direction and into the second kiln opening, the second end chamber, the central heating chamber, the first end chamber and convey a second dried lumber out the first end chamber;

a first at least one unidirectional fan configured to form a first air flow through lumber travelling on the first and second lumber conveyors in the first end chamber during operation of the kiln, the first unidirectional fan is external to the kiln;

a second at least one unidirectional fan configured to form a second air flow through lumber travelling on the first and second lumber conveyors in the second end chamber during operation of the kiln, the second unidirectional fan is external to the kiln; and a third at least one unidirectional fan configured to form a first central air flow through lumber travelling on the first and second lumber conveyors in the central heating chamber during operation of the kiln, wherein the third unidirectional fan is external to the kiln.

2. The kiln according to claim 1, further comprising a first baffle configured to separate first end chamber air in the first end chamber from central heating air in the central heating chamber and allow lumber to continuously travel between the first end chamber and the central heating chamber on the first and second lumber conveyors, a second baffle configured to separate second end chamber air in the second end chamber from the central heating air in the central heating chamber and allow lumber to continuously travel between the second end chamber and the central heating chamber on the first and second lumber conveyors during operation of the kiln.

3. The kiln according to claim 2, further comprising a central divider configured to divide at least an upper portion of the central heating chamber into a first central chamber and a second central chamber.

4. The kiln according to claim 3, further comprising a first air flow divider in the first end chamber dividing the first end chamber into a first treatment chamber and a first heat transfer chamber, and a second air flow divider in the second end chamber dividing the second end chamber into a second treatment chamber and a second heat transfer chamber.

5. The kiln according to claim 1, further comprising an overhead duct in the first end chamber that is over the first and second lumber conveyors, and the first at least one unidirectional fan is configured to flow the first air flow through the overhead duct and the lumber in the first end chamber during operation of the kiln, wherein the first air flow is a circular air flow.

6. The kiln according to claim 1, further comprising an overhead duct in the second end chamber that is over the first and second lumber conveyors, and the second at least one unidirectional fan is configured to flow the second air flow through the overhead duct and the lumber in the second end chamber during operation of the kiln, wherein the second air flow is a circular air flow.

7. The kiln according to claim 1, further comprising an overhead duct in the central heating chamber that is over the first and second lumber conveyors, and the third at least one unidirectional fan is configured to flow the first central air flow through the overhead duct and the lumber in the central heating chamber during operation of the kiln, wherein the first central air flow is a circular flow.

8. The kiln according to claim 3, wherein the third at least one unidirectional fan configured to form a first central air flow through lumber travelling on the first and second lumber conveyors in the first central chamber during operation of the kiln and the kiln further comprises a fourth at least one unidirectional fan configured to form a first central air flow through lumber travelling on the first and second lumber conveyors in the second central chamber during operation of the kiln.

9. The kiln according to claim 3, further comprising a first central overhead duct in the first central chamber that is over the first and second lumber conveyors, and the third at least one unidirectional fan is configured to flow the first central air flow through the first central overhead duct and the lumber in the first central chamber during operation of the kiln, wherein the first central air flow is a circular flow, and a second central overhead duct in the second central chamber that is over the first and second lumber conveyors, and a fourth at least one unidirectional fan is configured to flow the second central air flow through the second central overhead duct and the lumber in the second central chamber during operation of the kiln, wherein the second central air flow is a circular flow.

10. A method of continuously drying lumber in a kiln comprising:

conveying a first green lumber on a first lumber conveyor in a first direction into a first end chamber, a central heating chamber and a second end chamber of a kiln to form a first dry lumber exiting the central heating chamber into the second end chamber;

conveying a second green lumber on a second lumber conveyor in a direction opposite the first direction into the second end chamber, the central heating chamber, and the first end chamber to form a second dry lumber exiting the central heating chamber;

providing in the first end chamber a first circular air flow through the first green lumber and second dry lumber in a direction of the second dry lumber to the first green lumber by a first at least one unidirectional fan external from the kiln to transfer heat from the second dry lumber to the first green lumber;

providing in a second end chamber a second circular air flow through the second green lumber and first dry lumber in a direction of the first dry lumber to the second green lumber by a second at least one unidirectional fan external from the kiln to transfer heat from the first dry lumber to the second green lumber;

providing in a first portion of the central heating chamber a first center circular air flow through the first green lumber and the second green lumber in a direction of the first green lumber to the second green lumber by a third at least one unidirectional fan external from the kiln; and providing in a second portion of the central heating chamber a second center circular air flow through the first green lumber and the second green lumber in a direction of the second green lumber to the first green lumber by another third at least one unidirectional fan external from the kiln.

11. The method according to claim 10, wherein the circular air flows comprises flowing the air over the first and second lumber conveyors and through the first and second green lumber and first and second dry lumber.

12. The method according to claim 11, wherein the first and second circular air flows are not reversed as the first and second green lumber and first and second dry lumber pass through the first and second end chambers.

13. The method according to claim 10, wherein the first central circular air flow and the second central circular air flows comprise flowing air over the first and second lumber conveyors and through the first and second green lumber.

14. The method according to claim 10, wherein the first and second central circular air flows are not reversed as the first and second green lumber pass through the central heating chamber.

15. The method according to claim 10, further comprising providing a first treatment chamber in the first end chamber in which the first green lumber and the second dry lumber are exposed to minimal or no air flow and a humidity is 100%, and the first end chamber air flow is present in a first heat transfer chamber in the first end chamber.

16. The method according to claim 15, wherein the first treatment chamber being separated from the first heat transfer chamber by a first divider in the first end chamber.

17. The method according to claim 10, further comprising providing a second treatment chamber in the second end chamber in which the second green lumber and the first dry lumber are exposed to minimal or no air flow and a humidity is 100%, and the second end chamber air flow is present in a second heat transfer chamber in the second end chamber.

18. The method according to claim 17, wherein the second treatment chamber being separated from the second heat transfer chamber by a second divider in the second end chamber.

19. The method according to claim 10, wherein the first, second and third at least one fans are centrifugal fans.

20. A continuous kiln comprising:

a first end chamber having a first kiln opening;

a second end chamber having a second kiln opening;

a central heating chamber connecting the first end chamber to the second end chamber, the central heating chamber having a divider dividing the central heating chamber into a first central chamber and a second central chamber;

at least one lumber conveyor configured to continuously convey a green lumber in a lumber direction into the first kiln opening, first end chamber, the first central chamber, the second central chamber to form a dry lumber, convey the dry lumber through the second end chamber, and convey the dried lumber out the second kiln opening during operation of the kiln;

a first at least one unidirectional fan configured to form a first air flow through the green lumber travelling on the at least one lumber conveyor in the first end chamber during operation of the kiln, the first unidirectional fan is external to the kiln;

a second at least one unidirectional fan configured to form a second air flow through the dry lumber travelling on the at least one lumber conveyor in the second end chamber during operation of the kiln, the second unidirectional fan is external to the kiln;

a third at least one unidirectional fan configured to form a first central air flow through the green lumber travelling on the at least one lumber conveyor in the first central chamber during operation of the kiln; and a fourth at least one unidirectional fan configured to form a second central air flow through the green lumber travelling on the at least one lumber conveyor in the second central chamber during operation of the kiln, wherein the first at least one unidirectional fan and the second at least one unidirectional fan are configured to provide a circular air flow between the green lumber in the first end chamber and the dry lumber in the second end chamber during operation of the kiln, and wherein the third at least one unidirectional fan and the fourth at least one unidirectional fan are configured to provide a circular air flow between the green lumber in the first central chamber and the second central chamber during operation of the kiln.

21. The kiln according to claim 20, further comprising a first baffle configured to separate first end chamber air in the first end chamber from central heating air in the central heating chamber and allow lumber to continuously travel between the first end chamber and the central heating chamber on the at least one lumber conveyor, a second baffle configured to separate second end chamber air in the second end chamber from the central heating air in the central heating chamber and allow lumber to continuously travel between the second end chamber and the central heating chamber on the at least one lumber conveyor during operation of the kiln.

22. A method of continuously drying lumber in a kiln comprising:

conveying a green lumber on at least one lumber conveyor into a first kiln opening, a first end chamber, a first central chamber, a second central chamber, a second end chamber, and out of a second kiln opening, to form a second dry lumber exiting the second central chamber and entering the second end chamber;

providing heat to the first central chamber and the second central chamber;

providing a first circular air flow through the green lumber in the first end chamber and dry lumber in the second end chamber using at least one unidirectional fan external to the kiln to transfer heat from the dry lumber to the green lumber; and providing a second circular air flow through the green lumber in the first central chamber and the green lumber in the second central chamber to dry the green lumber and form the dry lumber exiting the second central chamber.

23. The method according to claim 22, further comprising at least two lumber conveyors conveying lumber in the same direction through the kiln.

24. The method according to claim 22, wherein directions of the first and second circular air flows are maintained during an entire time a piece of lumber travels on the at least one lumber conveyor through the first end chamber, first and second central chambers, and the second end chamber.

* * * * *